US008016626B2

(12) United States Patent
Suzuki et al.

(10) Patent No.: US 8,016,626 B2
(45) Date of Patent: Sep. 13, 2011

(54) MARINE PROPULSION SYSTEM

(75) Inventors: Takayoshi Suzuki, Shizuoka (JP); Mitsuhiro Ryuman, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 77 days.

(21) Appl. No.: 12/394,221

(22) Filed: Feb. 27, 2009

(65) Prior Publication Data

US 2009/0221193 A1 Sep. 3, 2009

(30) Foreign Application Priority Data

Feb. 29, 2008 (JP) ..... 2008-048952

(51) Int. Cl.
*B63H 20/14* (2006.01)

(52) U.S. Cl. ..... 440/75; 440/86

(58) Field of Classification Search ..... 440/1, 75, 440/76, 83, 88 M; 477/121; 74/335
See application file for complete search history.

(56) References Cited

U.S. PATENT DOCUMENTS 4,323,354 A * 4/1982 Blanchard ..... 440/75
5,711,742 A 1/1998 Leinonen et al.
5,888,108 A 3/1999 Iriono
6,200,177 B1 * 3/2001 Scott et al. ..... 440/75
6,350,165 B1 * 2/2002 Neisen ..... 440/75
6,435,923 B1 * 8/2002 Ferguson ..... 440/75
7,494,394 B2 * 2/2009 Walser et al. ..... 440/1

FOREIGN PATENT DOCUMENTS

JP 09-263294 A 10/1997

* cited by examiner

*Primary Examiner* — Lars A Olson
(74) *Attorney, Agent, or Firm* — Keating & Bennett, LLP

(57) ABSTRACT

A marine propulsion system that achieves both an acceleration performance and top speed closer to the performance desired by a boat driver includes an engine, propellers rotated by the driving force of the engine, a transmission mechanism arranged to convey the driving force of the engine to the propellers at least after shifting into a low speed reduction gear ratio and into a high speed reduction gear ratio, an acceleration sensor arranged to detect the acceleration of a hull propelled by the rotation of the propellers, and a control section and an ECU arranged to carry out the control for changing the reduction gear ratio of the transmission mechanism. The control section and the ECU are configured to control the transmission mechanism to shift from the low speed reduction gear ratio into the high speed reduction gear ratio based on the acceleration of the hull.

9 Claims, 14 Drawing Sheets

MARINE PROPULSION SYSTEM

BACKGROUND OF THE INVENTION

1. Field of the Invention

The present invention relates to a marine propulsion system, especially a marine propulsion system provided with an engine.

2. Description of the Related Art

Conventionally, a marine propulsion device (a marine propulsion system) provided with an engine is known (see JP-A-Hei 9-263294, for instance). JP-A-Hei 9-263294 discloses a marine propulsion device provided with an engine and a power transmission mechanism that conveys the driving force of the engine to a propeller at a predetermined fixed reduction ratio. This marine propulsion device is configured to convey the driving force of the engine directly to the propeller via the power transmission mechanism, and is configured so that the propeller rotation frequency increases corresponding to the increase of the engine speed.

However, the marine propulsion device (marine propulsion system) disclosed in JP-A-Hei 9-263294 has a disadvantage in that it is difficult to improve the acceleration performance in the low speed range when the reduction ratio of the power transmission mechanism is configured to achieve the higher top speed. On the contrary, when the reduction ratio of the power transmission mechanism is configured to improve the acceleration performance in the low speed range, it has a disadvantage in that the higher top speed is difficult to achieve. Thus, the marine propulsion device disclosed in JP-A-Hei 9-263294 involves an issue that it is difficult to bring both the acceleration performance and the top speed closer to the performance desired by the boat driver.

SUMMARY OF THE INVENTION

In order to overcome the problems described above, preferred embodiments of the present invention provide a marine propulsion system that achieves both an acceleration performance and the top speed closer to levels expected by a boat driver.

A marine propulsion system according to a preferred embodiment of the present invention includes an engine, a propeller rotated by the driving force of the engine, a transmission mechanism capable of conveying the driving force of the engine to the propeller at least after shifting into a low speed reduction gear ratio and into a high speed reduction gear ratio, an acceleration detecting section arranged to detect the acceleration of the hull propelled by the rotation of the propeller, and a control section arranged to carry out the control for changing the reduction gear ratio of the transmission mechanism, wherein the control section is configured to control the transmission mechanism to shift from the low speed reduction gear ratio into the high speed reduction gear ratio based on the acceleration of the hull.

In the marine propulsion system according to a preferred embodiment of present invention, the transmission mechanism is capable of conveying the driving force generated by the engine to the propeller at least after shifting into the low speed reduction gear ratio and into the high speed reduction gear ratio, as described above. In this way, as the transmission mechanism is configured to be capable of conveying the driving force generated by the engine to the propeller after shifting into the low speed reduction gear ratio, the acceleration performance in the low speed area can be improved. Also, as the transmission mechanism is configured to be capable of conveying the driving force generated by the engine to the propeller after shifting into the high speed reduction gear ratio, the higher top speed can be attained. Consequently, it is practicable to bring both the acceleration performance and the top speed closer to the performance desired by the boat driver.

Further, by providing the acceleration detecting section arranged to detect the acceleration of the hull, the control section can distinguish the actual accelerating state for each type of hull, when the marine propulsion system according to the present preferred embodiment of the present invention is applied to the various hull models having different sizes and shapes. Thus, different from the case where the accelerating state of the hull is estimated based on the engine speed, the throttle opening of the engine and so on, the control section can distinguish the actual accelerating state that varies for each hull model. Also, by controlling the transmission mechanism to shift from the low speed reduction gear ratio into the high speed reduction gear ratio based on the acceleration of the hull, shifting from the low speed reduction gear ratio into the high speed reduction gear ratio can be carried out in response to the actual accelerating state of the hull. Thus, shifting from the low speed reduction gear ratio into the high speed reduction gear ratio can be carried out at the optimal timing depending on each hull model.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described in the following sections based on the drawings.

Figure 1:
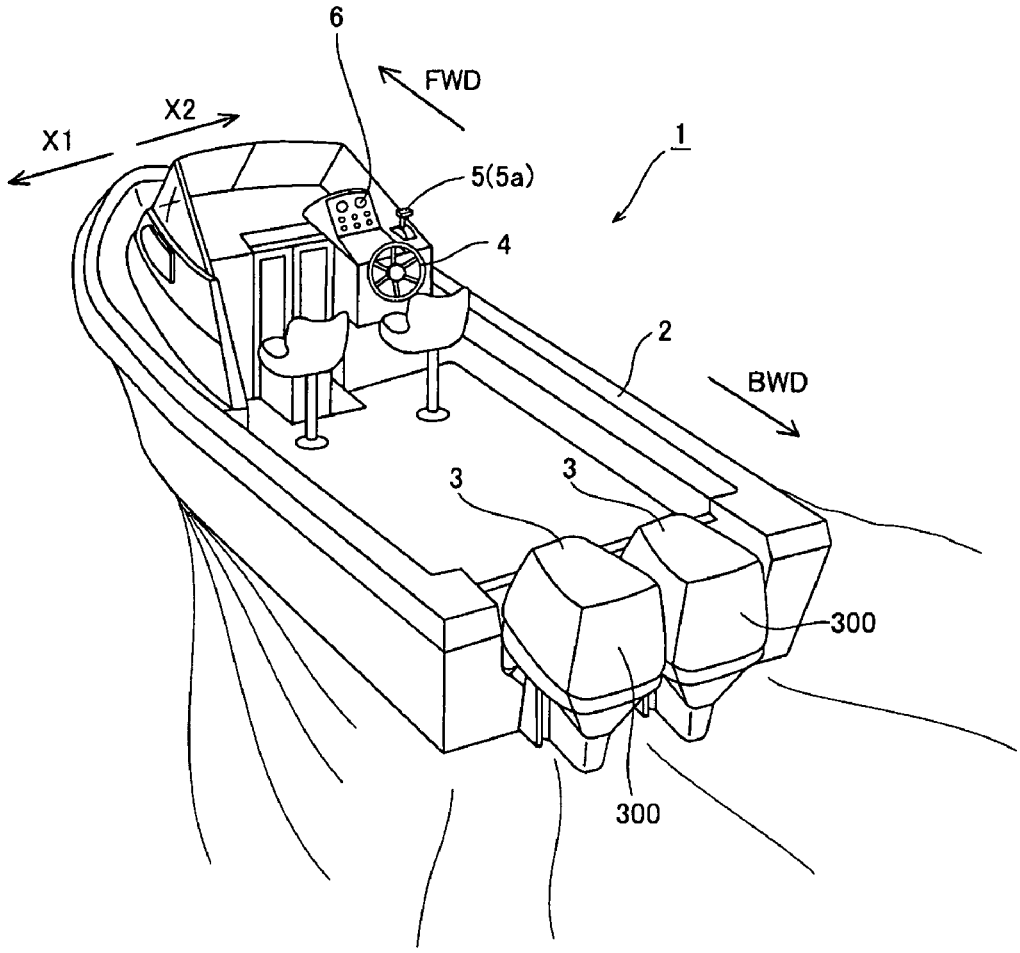
FIG. 1 is a perspective view of a watercraft equipped with a marine propulsion system according to a preferred embodiment of the present invention.
Figure 2:
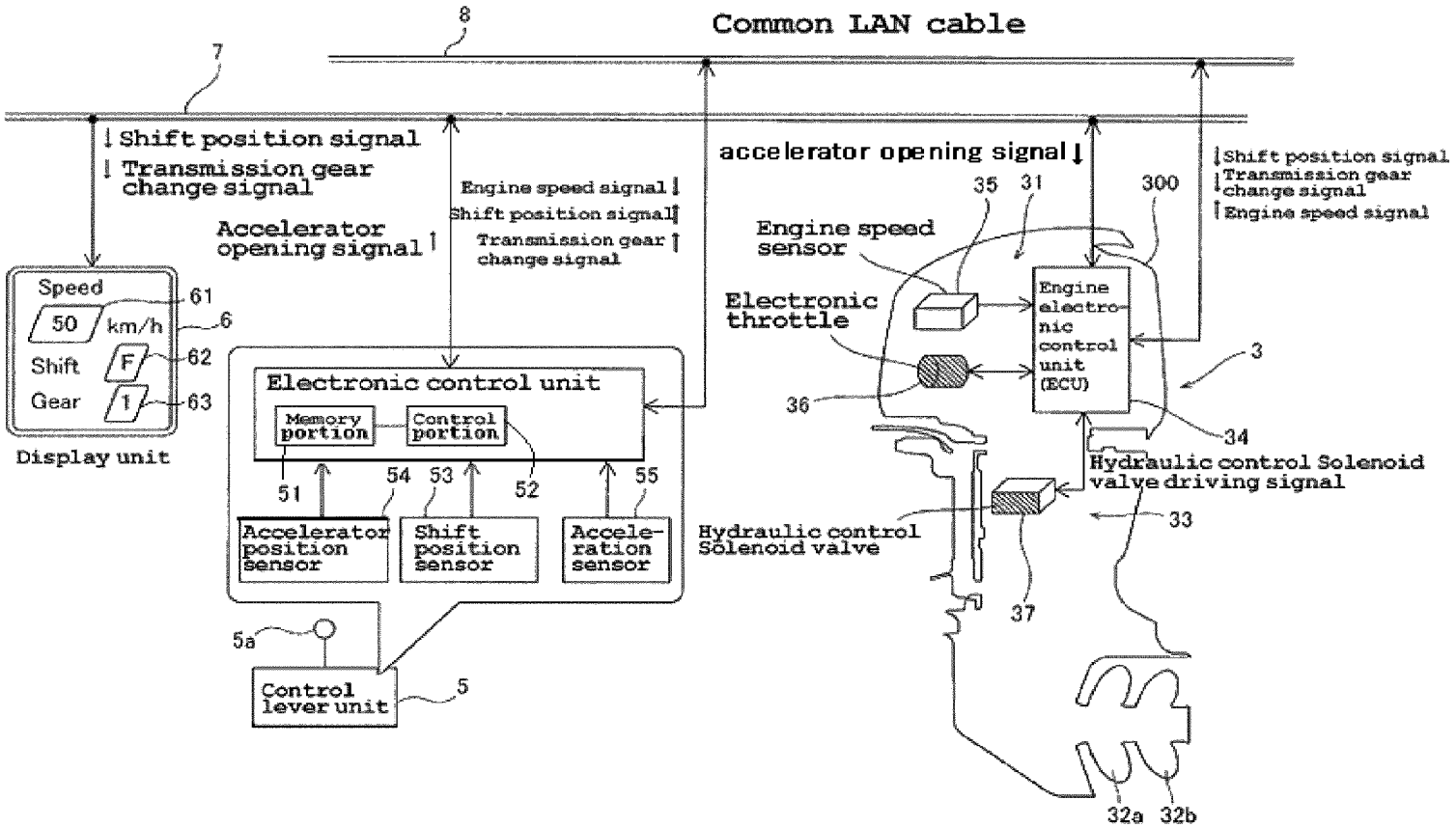
FIG. 2 is a block diagram showing a configuration of the marine propulsion system according to a preferred embodiment of the present invention.

FIG. 1 is a perspective view of a watercraft equipped with a marine propulsion system according to a preferred embodiment of the present invention. FIG. 2 is a block diagram showing a configuration of the marine propulsion system according to a preferred embodiment of the present invention. FIGS. 3 through 7 are drawings for the detailed description of the marine propulsion system according to a preferred embodiment of the present invention as shown in FIG. 1. In the figures, "FWD" indicates the direction of forward travel of the watercraft, and "BWD" indicates the direction of reverse travel of the watercraft. First, a configuration of a watercraft 1 and a marine propulsion system mounted on a watercraft 1 according to the present preferred embodiment will be described referring to FIGS. 1 through 7.

As shown in FIG. 1, the watercraft 1 according to this embodiment is provided with a hull 2 made to float on water, two outboard motors 3 mounted to the rear portion of the hull 2 for propelling the hull 2, a steering section 4 for steering the hull 2, a control lever unit 5 located in the vicinity of the steering section 4 and having a lever section 5*a* that is rotatable in the forward and backward direction, and a display unit 6 located in the vicinity of the control lever unit 5. Further, as shown in FIG. 2, the outboard motors 3, the control lever unit 5 and the display unit 6 are connected with each other preferably via a common LAN cable 7 and a common LAN cable 8. The outboard motors 3, the steering section 4, the control lever unit 5, the display unit 6, the common LAN cable 7 and the common LAN cable 8 constitute a marine propulsion system.

As shown in FIG. 1, the two outboard motors 3 preferably are disposed symmetrically with each other relative to the center of the hull 2 in a width direction (in the direction indicated by arrows X1 and X2). Also, the outboard motor 3 is covered with a case 300. The case 300 is preferably formed of resin, and has a function to protect the inner parts of the outboard motor 3 against water and so on. Further, the outboard motor 3 includes an engine 31, two propellers 32*a*, 32*b* (see FIG. 4) to convert the driving force of the engine 31 into the thrust of the watercraft 1, a transmission mechanism 33 capable of conveying the driving force generated by the engine 31 to the propellers 32*a* and 32*b* after shifting into a low speed reduction gear ratio (approximately 1.33:approximately 1.00) and into a high speed reduction gear ratio (approximately 1.00:approximately 1.00), and an ECU (engine electronic control unit) 34 for electrically controlling the engine 31 and the transmission mechanism 33. Note that the ECU 34 is an example of "control section" according to a preferred embodiment of the present invention. Also, the ECU 34 is connected to the engine speed sensor 35 to detect the rotation frequency of the engine 31. The ECU 34 is also connected to an electronic throttle 36 to control the opening of the throttle valve (not shown) in the engine 31 based on the accelerator opening signal which will be described later. The engine speed sensor 35, located in the vicinity of a crankshaft 301 of the engine 31 (see FIG. 4), functions to detect the rotation frequency of the crankshaft 301 and to transmit the detected rotation frequency of the crankshaft 301 to the ECU 34. Note that the rotation frequency of the crankshaft 301 according to this preferred embodiment is an example of "rotation frequency of the engine" according to a preferred embodiment of the invention. Also, the electronic throttle 36 has not only a function to control the opening of the throttle valve (not shown) in the engine 31 based on an accelerator opening signal from the ECU 34, but also a function to transmit the throttle opening to the ECU 34 and to a control section 52 which will be described later.

In this preferred embodiment, the ECU 34 has a function to generate a hydraulic control solenoid valve driving signal based on a shift position signal and a transmission gear change signal sent by the control section 52 of the control lever unit 5 which will be described later. Also, the ECU 34 is connected to a hydraulic control solenoid valve 37, and is configured to carry out the control to send the hydraulic control solenoid valve driving signal to the hydraulic control solenoid valve 37. Then, the hydraulic control solenoid valve 37 is driven based on the hydraulic control solenoid valve driving signal, which in turn controls the transmission mechanism 33. The structure and operation of the transmission mechanism 33 will be described later in detail.

Further, in this preferred embodiment, the control lever unit 5 preferably includes a memory section 51 in which gear shift control maps (a gear shift-up control map and a gear shift-down control map) are stored, and the control section 52 that generates signals (the transmission gear change signal, the shift position signal, and the accelerator opening signal) to be sent to the ECU 34. In addition, the control lever unit 5 further contains a shift position sensor 53 detecting the shift position of the lever section 5*a*, an accelerator position sensor 54 detecting the accelerator opening, namely the position of the lever section 5*a* (lever opening angle) as a result of a boat driver's operation, and an acceleration sensor 55 detecting the acceleration of the hull 2. The shift position sensor 53 is provided to detect the shift position in terms of the position of the lever section 5*a* whether it is in a neutral position, in a forward position relative to the neutral position, or in a rearward position relative to the neutral position. The memory section 51 and the control section 52 are connected with each other. The control section 52 is configured to be capable of reading out the gear shift control maps and so on stored in the memory section 51. Also, the control section 52 is connected to both the shift position sensor 53 and the accelerator position sensor 54. This connection allows the control section 52 to obtain a signal (the shift position signal) detected by the shift position sensor 53, and the accelerator opening signal detected by the accelerator position sensor 54. Note that the acceleration sensor 55 is an example of "acceleration detecting section" according to a preferred embodiment of the present invention.

The control section 52 is connected to the common LAN cable 7 and the common LAN cable 8, respectively. The common LAN cables 7 and 8, connected to the ECU 34 respectively, have functions to transmit the signals generated by the control section 52 to the ECU 34, and also to transmit the signals generated by the ECU 34 to the control section 52. Namely, each of the common LAN cables 7 and 8 are configured to allow communication between the control section 52 and the ECU 34. In addition, the common LAN cable 8 is arranged to be electrically independent of the common LAN cable 7.

Specifically, the control section 52 is configured to transmit the shift position signal regarding the lever section 5*a* detected by the shift position sensor 53 to the display unit 6 and the ECU 34 by way of the common LAN cable 7. The control section 52 is configured to transmit the shift position signal only by way of the common LAN cable 7 without using the common LAN cable 8. Further, the control section 52 is configured to transmit the accelerator opening signal detected by the accelerator position sensor 54 to the ECU 34 only by way of the common LAN cable 8 without using the common LAN cable 7. In addition, the control section 52 is configured to be capable of receiving the engine speed signal sent by the ECU 34 by way of the common LAN cable 8.

In this preferred embodiment, the control section 52 also has a function to shift the reduction gear ratio of the transmission mechanism 33 according to the operation of the control lever unit 5 by the boat driver. Specifically, the control section 52 has a function to generate the transmission gear change signal that controls the transmission mechanism 33 to shift into the low speed reduction gear ratio, based on the gear shift-down control map defined by the accelerator opening and the engine speed stored in the memory section 51. Also, the control section 52 has a function to generate the transmission gear change signal that controls the transmission mechanism 33 to shift into the high speed reduction gear ratio, based on the gear shift-up control map defined by the acceleration decreasing ratio and the accelerator opening stored in the memory section 51. The gear shift control map will be described later in detail. Further, the control section 52 is configured to send the generated transmission gear change signal to the ECU 34 by way of the common LAN cables 7 and 8.

Figure 3:
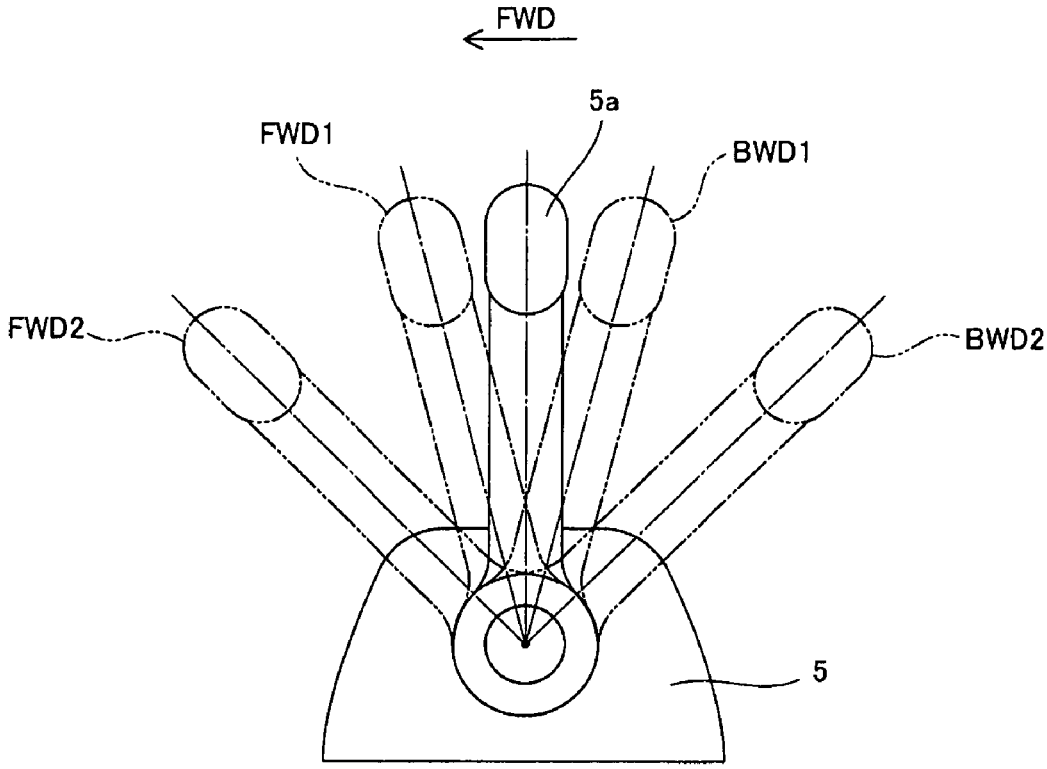
FIG. 3 is a side view illustrating a structure of a control lever unit for the marine propulsion system according to a preferred embodiment of the present invention shown in FIG. 1.

The transmission mechanism 33 is configured to be controlled so that the hull 2 can go forward when the lever section 5*a* of the control lever unit 5 is rotated forward (in the direction of an arrow FWD) (see FIG. 3). The transmission mechanism 33 is also configured to be controlled into the neutral state in which the hull 2 can travel neither in the forward nor reverse direction when the lever section 5*a* is not rotated forward or backward as shown by the lever section 5*a* of the control lever unit 5 (see the solid line contour in FIG. 3). The transmission mechanism 33 is also configured to be controlled so that the hull 2 can go astern when the lever section 5*a* of the control lever unit 5 is rotated backward (in the opposite direction to an arrow FWD) (see FIG. 3).

In addition, the transmission mechanism 33 is configured so that a shift-in (cancellation of the neutral state) is performed with the throttle valve (not shown) in the engine 31 fully closed (idling state), once the lever section 5*a* of the control lever unit 5 is rotated to FWD 1 position in FIG. 3. Also, the transmission mechanism 33 is configured so that the throttle valve (not shown) in the engine 31 reaches the full open state, once the lever section 5*a* of the control lever unit 5 is rotated to FWD 2 position in FIG. 3.

Similar to the case in which the lever section 5*a* of the control lever unit 5 is rotated in the direction of arrow FWD, the transmission mechanism 33 is configured so that a shift-in (cancellation of the neutral state) is performed with the throttle valve (not shown) in the engine 31 fully closed (idling state), once the lever section 5*a* of the control lever unit 5 is rotated to BWD 1 position in FIG. 3, in the opposite direction to the arrow FWD. Also, the transmission mechanism 33 is configured so that the throttle valve (not shown) in the engine 31 reaches the full open state, once the lever section 5*a* of the control lever unit 5 is rotated to the BWD 2 position in FIG. 3.

The display unit 6 includes a speed indicator 61 showing the traveling speed of the watercraft 1, a shift position indicator 62 showing a shift position at which the lever section 5*a* of the control lever unit 5 is positioned, and a gear indicator 63 showing the gear with which the transmission mechanism 33 is engaged. The traveling speed of the watercraft 1 displayed on the speed indicator 61 is calculated by the ECU 34 based on the engine speed sensor 35 and the amount of intake air to the engine 31. Then, the calculated traveling speed data of the watercraft 1 is configured to be transmitted to the display unit 6 by way of the common LAN cables 7 and 8. Also, the shift position shown on the shift position indicator 62 is configured to be displayed based on the shift position signal sent by the control unit 52 of the control lever unit 5. Further, the gear shown on the gear indicator 63 and with which the transmission mechanism 33 is engaged, is configured to be displayed based on the transmission gear change signal sent by the control section 52 of the control lever unit 5. Namely, the display unit 6 has a function to make the boat driver understand the operating conditions of the watercraft 1.

Figure 4:
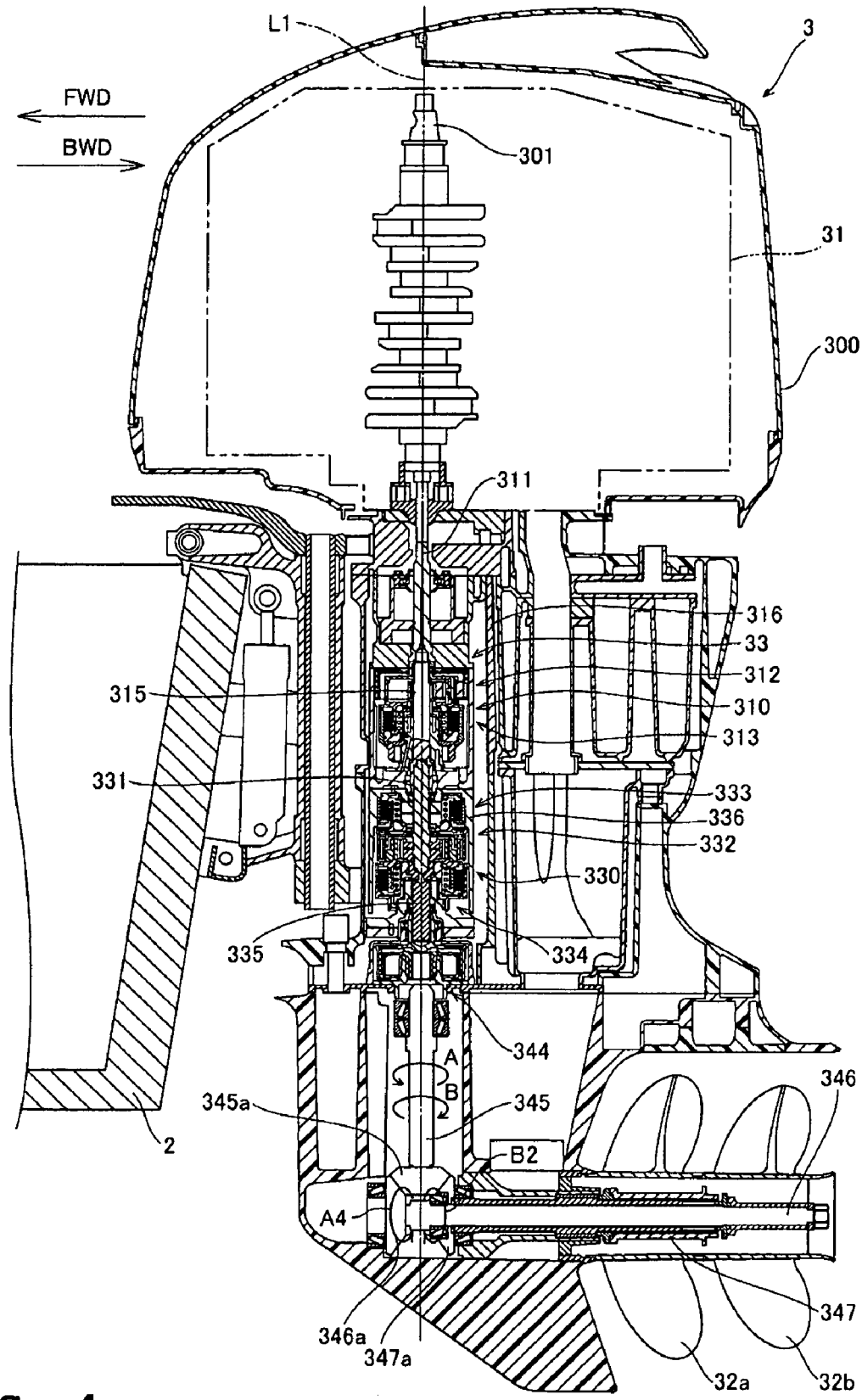
FIG. 4 is a side view illustrating a structure of the main body of the marine propulsion system according to a preferred embodiment of the present invention shown in FIG. 1.

Next, the structure of the engine 31 and the transmission mechanism 33 will be described. As shown in FIG. 4, the engine 31 is provided with the crankshaft 301 rotating around an axis L1. The engine 31 is constructed to generate the driving force by rotating the crankshaft 301. Also, the crankshaft 301 is connected to the upper portion of an upper transmission shaft 311 of the transmission mechanism 33. The upper transmission shaft 311 is disposed on the axis L1, and is configured to rotate around the axis L1 corresponding to the rotation of the crankshaft 301.

The transmission mechanism 33 preferably includes an upper transmission section 310 that includes the upper transmission shaft 311 to which the driving force of the engine 31 is input and changes gears to allow the watercraft 1 to travel either in high-speed mode or in low-speed mode, and a lower transmission section 330 for changing gears to allow the watercraft 1 to travel either forward or reverse. Namely, the transmission mechanism 33 is constructed to be capable of conveying the driving force generated by the engine 31 to the propellers 32*a* and 32*b* after shifting into the low speed reduction gear ratio (1.33:1.00) and into the high speed reduction gear ratio (1.00:1.00) in the forward traveling, and also to be capable of conveying the driving force generated by the engine 31 to the propellers 32*a* and 32*b* after shifting into a low speed reduction gear ratio and into a high speed reduction gear ratio in the reverse traveling.

Figure 5:
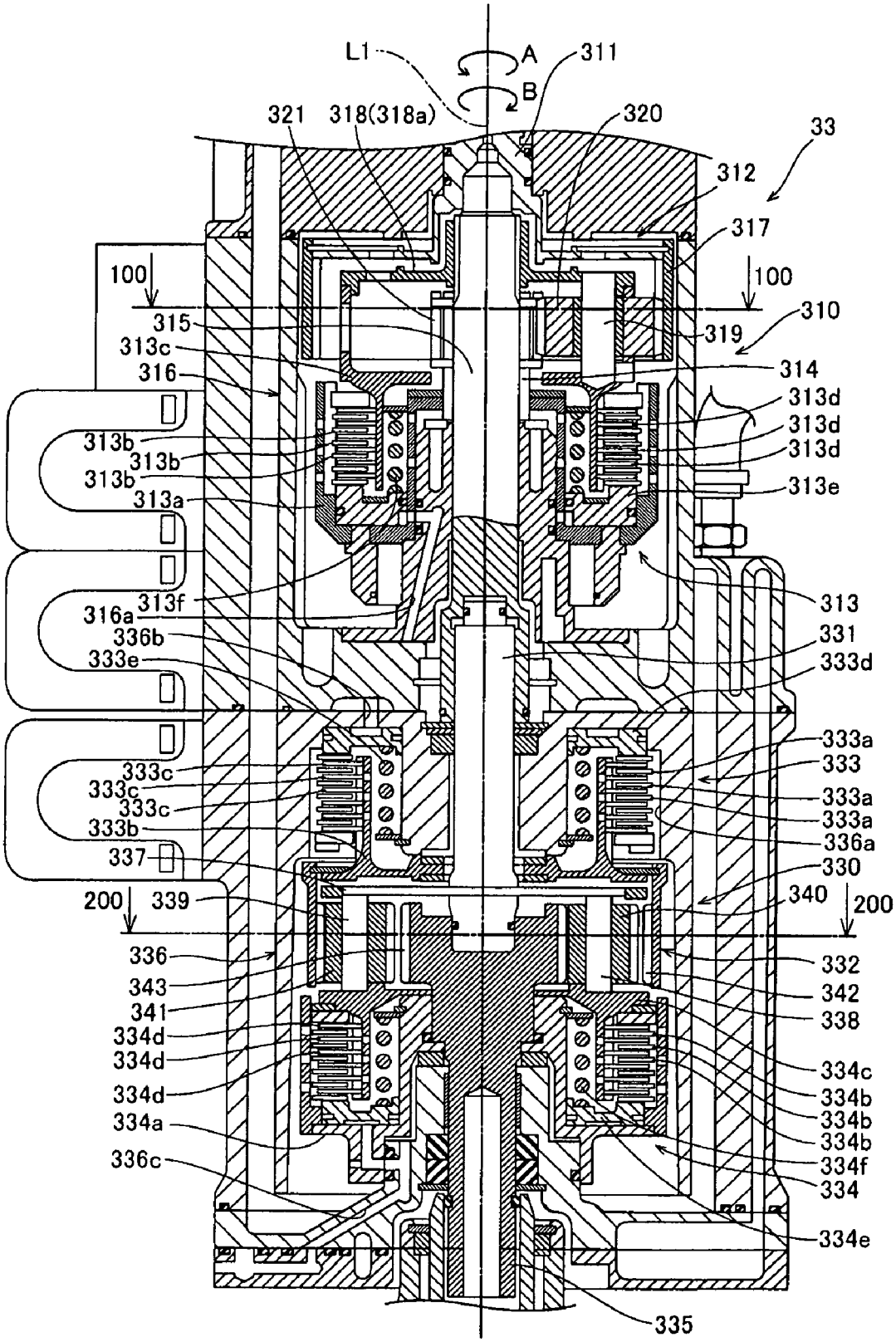
FIG. 5 is a side view illustrating a structure of the transmission mechanism in the main body of the marine propulsion system according to a preferred embodiment of the present invention shown in FIG. 1.

As shown in FIG. 5, the upper transmission section 310 includes the upper transmission shaft 311, a planetary gear section 312 capable of speed reduction of the driving force of the upper transmission shaft 311, a clutch section 313 and a one-way clutch 314 controlling the rotation of the planetary gear section 312, an intermediate shaft 315 to which the driving force of the upper transmission shaft is conveyed by way of the planetary gear section 312, and an upper case section 316 constituting an external shape of the upper transmission section 310 by the plural members. The intermediate shaft 315 is configured to rotate substantially without speed reduction relative to the rotation frequency of the upper transmission shaft 311, when the clutch section 313 is in an engaged state. When the clutch section 313 is in a disengaged state, on the other hand, the intermediate shaft 315 is configured to rotate at the reduced speed rotation frequency compared to the upper transmission shaft 311, because the planetary gear section 312 is rotated.

Figure 6:
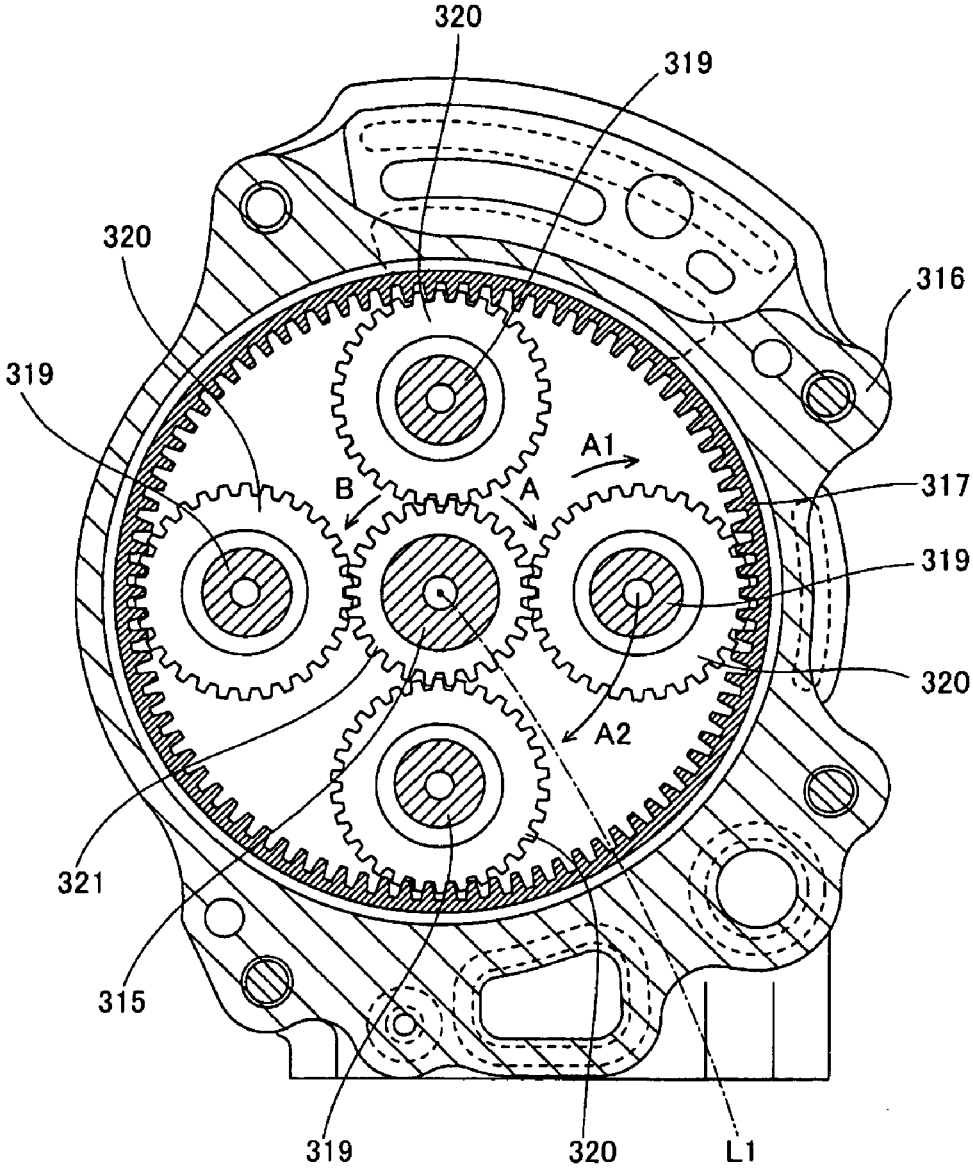
FIG. 6 is a sectional view taken along the line 100-100 shown in FIG. 5.

Specifically, a ring gear 317 is provided in a lower portion of the upper transmission shaft 311. Also, a flange member 318 is splined into an upper portion of the intermediate shaft 315. The flange member 318 is disposed inside the ring gear 317 (closer to the axis L1), and, as shown in FIGS. 5 and 6, four shaft members 319 are fixed to the flange portion 318*a* of the flange member 318. The four shaft members 319 are fitted with four planetary gears 320 respectively in a rotatable manner, and each of the four planetary gears 320 is engaged with the ring gear 317. Also, each of the four planetary gears 320 is engaged with a sun gear 321 that is rotatable around the axis L1. As shown in FIG. 5, the sun gear 321 is supported by the one-way clutch 314. Further, the one-way clutch 314 is mounted to the upper case section 316 and configured to be rotatable only in the direction "A". Thus, the sun gear 321 is configured to be rotated one-way (in the direction "A") only.

The clutch section 313 is preferably a wet-type multiple disc clutch. The clutch section 313 is mainly made up of an outer case section 313*a* supported by the one-way clutch 314 to be rotatable only in the direction "A", a plurality of clutch plates 313*b* disposed separately with each other at a given distance at the inner periphery of the outer case section 313*a*, an inner case section 313*c* disposed at least partly inside the outer case section 313*a*, and a plurality of clutch plates 313*d* attached to the inner case section 313*c* to be disposed in the respective gaps of a plurality of the clutch plates 313*b*. Further, the clutch section 313 is configured so that the outer case section 313*a* and the inner case section 313*c* enter into an engaged state to rotate integrally, when the clutch plates 313*b* of the outer case section 313*a* and the clutch plates 313*d* of the inner case section 313*c* come in contact with each other. On the other hand, the clutch section 313 is configured so that the outer case section 313*a* and the inner case section 313*c* enter into a disengaged state to disable united rotation, when the clutch plates 313*b* of the outer case section 313*a* and the clutch plates 313*d* of the inner case section 313*c* are separated from each other.

Specifically, a piston section 313*e* is disposed on the outer case section 313*a*, which is capable of sliding along an inner peripheral surface of the outer case section 313*a*. The piston section 313*e* is configured to move each of a plurality of the clutch plates 313*b* of the outer case section 313*a* in the sliding direction of the piston section 313*e*, when the piston section 313*e* makes a sliding motion along the inner peripheral surface of the outer case section 313*a*. In addition, a helical compression spring 313*f* is disposed in the outer case section 313*a*. The helical compression spring 313*f* is disposed to urge the piston section 313*e* in the direction to separate the clutch plates 313*b* of the outer case section 313*a* from the clutch plates 313*d* of the inner case section 313*c*. Also, the piston section 313*e* is configured to slide along the inner peripheral surface of the outer case section 313*a* resisting the reaction force of the helical compression spring 313*f*, when pressure of the oil circulating in the oil passage 316*a* of the upper case section 316 is increased by the hydraulic control solenoid valve 37 described above. In this way, the clutch plates 313*b* of the outer case section 313*a* and the clutch plates 313*d* of the inner case section 313*c* can be controlled to come in contact or to separate from each other by increasing or decreasing the pressure of the oil circulating in the oil passage 316*a* of the upper case section 316, and thus the clutch section 313 can be engaged and disengaged.

Further, the lower end of the four shaft members 319 are attached to an upper portion of the inner case section 313*c*. More specifically, through the four shaft members 319, the inner case section 313*c* is connected to the flange member 318 to which an upper part of each four shaft member 319 is attached. Thus, the inner case section 313*c*, the flange member 318, and the shaft members 319 can be rotated simultaneously around the axis L1.

With the planetary gear section 312 and the clutch section 313 are configured as described above, the ring gear 317 is rotated in the direction "A" corresponding to the rotation of the upper transmission shaft 311 in the direction "A", when the clutch section 313 is disengaged. In this condition, since the sun gear 321 cannot be rotated in the direction "B" that is opposite to the direction "A", each of the planetary gears 320 is rotated in the direction "A1" around the shaft member 319, and at the same time, moved in the direction "A2" together with the shaft member 319 around the axis L1, as shown in FIG. 6. Thus, the flange member 318 (see FIG. 5) is rotated in the direction "A" around the axis L1 corresponding to the movement of the shaft members 319 in the direction "A2". Consequently, the intermediate shaft 315 that is splined into the flange member 318 can be rotated in the direction "A" around the axis L1 at the reduced speed rotation frequency compared to the upper transmission shaft 311.

Also, as the planetary gear section 312 and the clutch section 313 are configured as described above, the ring gear 317 is rotated in the direction "A" corresponding to the rotation of the upper transmission shaft 311 in the direction "A", when the clutch section 313 is engaged. In this condition, since the sun gear 321 cannot be rotated in the direction "B" that is opposite to the direction "A", each of the planetary gears 320 is rotated in the direction "A1" around the shaft member 319, and at the same time, moved in the direction "A2" together with the shaft member 319 around the axis L1. Then, since the clutch section 313 is engaged, the outer case section 313*a* (see FIG. 5) of the clutch section 313 is rotated in the direction "A" together with the one-way clutch 314 (see FIG. 5). Accordingly, the sun gear 321 is rotated in the direction "A" around the axis L1, and thus, the shaft members 319 are moved in the direction "A" around the axis L1, substantially without the rotating movement of the planetary gears 320 around the shaft members 319. In this way, the flange member 318 is rotated at generally the same rotation frequency as the upper transmission shaft 311, without any substantial speed reduction caused by the planetary gears 320. Consequently, the intermediate shaft 315 can be rotated in the direction "A" around the axis L1 at generally the same rotation frequency as the upper transmission shaft 311.

As shown in FIG. 5, the lower transmission section 330 is provided below the upper transmission section 310. The lower transmission section 330 preferably includes an intermediate transmission shaft 331 connected to the intermediate shaft 315, planetary gear section 332 capable of speed reduction of the driving force of the intermediate transmission shaft 331, a backward and forward switching clutch section 333 and a backward and forward switching clutch section 334 for controlling rotation of the planetary gear section 332, a lower transmission shaft 335 to which the driving force of the intermediate transmission shaft 331 is conveyed by way of the planetary gear section 332, and a lower case section 336 constituting an external shape of the lower transmission section 330. The lower transmission section 330 is configured so that the lower transmission shaft 335 rotates in the opposite direction (direction "B") to the rotational direction of the intermediate shaft 315 (and the upper transmission shaft 311) (direction "A"), when the backward and forward switching clutch section 333 is engaged and the backward and forward switching clutch section 334 is disengaged. In this case, the lower transmission section 330 is configured to rotate only the propeller 32*a*, while hindering the rotation of the propeller 32*b*, so that the watercraft 1 can go astern. On the other hand, the lower transmission section 330 is configured so that the lower transmission shaft 335 rotates in the same direction as the rotational direction of the intermediate shaft 315 (and the upper transmission shaft 311) (direction "A"), when the backward and forward switching clutch section 333 is disengaged and the backward and forward switching clutch section 334 is engaged. In this case, the lower transmission section 330 is configured to make the propeller 32*a* rotate in the direction opposite to the direction in which the watercraft 1 goes astern, so that the watercraft 1 can go forward, and at the same time, to make the propeller 32*b* rotate in the opposite direction to the propeller 32*a*. Note that the lower transmission section 330 is configured to hinder simultaneous engagement of the backward and forward switching clutch sections 333 and 334. Also, the lower transmission section 330 is configured so that the rotation of the intermediate shaft 315 (and the upper transmission shaft 311) is not conveyed to the lower transmission shaft 335 (in the neutral state), when both the backward and forward switching clutch sections 333 and 334 are in the disengaged state.

Figure 7:
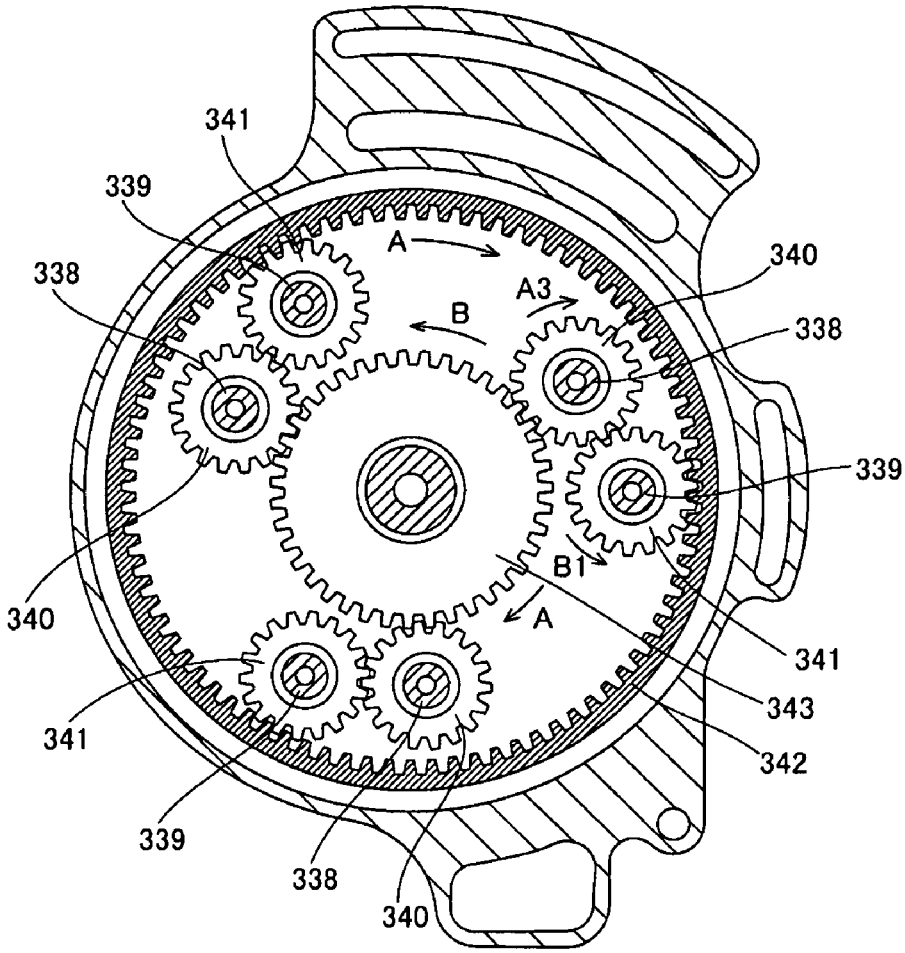
FIG. 7 is a sectional view taken along the line 200-200 shown in FIG. 5.

Specifically, the intermediate transmission shaft 331 is configured to rotate together with the intermediate shaft 315, and a flange portion 337 is provided in the lower portion of the intermediate transmission shaft 331. As shown in FIGS. 5 and 7, three inner shaft members 338 and three outer shaft members 339 are fixed to the flange portion 337. The three inner shaft members 338 are fitted with three inner planetary gears 340 respectively in a rotatable manner, and each of the three inner planetary gears 340 is engaged with a sun gear 343 which will be described later. Also, the three outer shaft members 339 are fitted with three outer planetary gears 341, respectively in a rotatable manner. Each of the three outer planetary gears 341 is engaged with the inner planetary gear 340, and at the same time, engaged with a ring gear 342 which will be described later.

The backward and forward switching clutch section 333 is provided in the inside upper portion of the lower case section 336. The backward and forward switching clutch section 333 is preferably a wet-type multiple disc clutch, a portion of which is composed of a recess 336*a* of the lower case section 336. Further, the backward and forward switching clutch section 333 is mainly made up of a plurality of clutch plates 333*a* disposed separately from each other at a given distance at the inner periphery of the recess 336*a*, an inner case section 333*b* disposed at least partly inside the recess 336*a*, and a plurality of clutch plates 333*c* attached to the inner case section 333*b* to be disposed in the respective gaps of a plurality of the clutch plates 333*a*. Also, the backward and forward switching clutch section 333 is configured so that rotation of the inner case section 333*b* is restricted by the lower case section 336, when the clutch plates 333*a* in the recess 336*a* and the clutch plates 333*c* of the inner case section 333*b* are in contact with each other. On the other hand, the backward and forward switching clutch section 333 is configured so that the inner case section 333*b* is rotated freely against the lower case section 336, when the clutch plates 333*a* in the recess 336*a* and the clutch plates 333*c* of the inner case section 333*b* are separated from each other.

Specifically, a piston section 333*d*, capable of sliding along an inner peripheral surface of the recess 336*a*, is disposed in the recess 336*a* of the lower case section 336. The piston section 333*d* is configured to move the clutch plates 333*a* in the recess 336*a* in the sliding direction of the piston section 333*d*, when the piston section 333*d* makes a sliding motion along the inner peripheral surface of the recess 336*a*. In addition, a helical compression spring 333*e* is disposed in the recess 336*a* of the lower case section 336. The helical compression spring 333*e* is disposed to urge the piston section 333*d* in the direction to separate the clutch plates 333*a* in the recess 336*a* from the clutch plates 333*c* of the inner case section 333*b*. Also, the piston section 333*d* is configured to slide along the inner peripheral surface of the recess 336*a* resisting the reaction force of the helical compression spring 333*e*, when pressure of the oil circulating in an oil passage 336*b* of the lower case section 336 is increased by the hydraulic control solenoid valve 37 described above. In this way, the backward and forward switching clutch section 333 can be engaged and disengaged by increasing or decreasing the pressure of the oil circulating in the oil passage 336*b* of the lower case section 336.

The annular shaped ring gear 342 is mounted on the inner case section 333*b* of the backward and forward switching clutch section 333. As shown in FIGS. 5 and 7, the ring gear 342 is engaged with the three outer planetary gears 341.

Also as shown in FIG. 5, the backward and forward switching clutch section 334 is provided in the inside lower portion of the lower case section 336, and is preferably a wet-type multiple disc clutch. Further, the backward and forward switching clutch section 334 is mainly made up of an outer case section 334*a*, a plurality of clutch plates 334*b* disposed separately with each other at a given distance at the inner periphery of the outer case section 334*a*, an inner case section 334*c* disposed at least partly inside the outer case section 334*a*, and a plurality of clutch plates 334*d* attached to the inner case section 334*c* to be disposed in the respective gaps of a plurality of the clutch plates 333*a*. Further, the backward and forward switching clutch section 334 is configured so that the inner case section 334*c* and the outer case section 334*a* rotate integrally around the axis L1, when the clutch plates 334*b* of the outer case section 334*a* and the clutch plates 334*d* of the inner case section 334*c* come in contact with each other. On the other hand, the backward and forward switching clutch section 334 is configured so that the inner case section 334*c* is rotated freely against the outer case section 334*a*, when the clutch plates 334*b* of the outer case section 334*a* and the clutch plates 334*d* of the inner case section 334*c* are separated from each other.

Specifically, a piston section 334*e* is disposed on the outer case section 334*a*, which is capable of sliding along an inner peripheral surface of the outer case section 334*a*. The piston section 334*e* is configured to move a plurality of the clutch plates 334*b* of the outer case section 334*a* in the sliding direction of the piston section 334*e*, when the piston section 334*e* makes a sliding motion along the inner peripheral surface of the outer case section 334*a*. In addition, a helical compression spring 334*f* is disposed inside the outer case section 334*a*. The helical compression spring 334*f* is disposed to urge the piston section 334*e* in the direction to separate the clutch plates 334*b* of the outer case section 334*a* from the clutch plates 334*d* of the inner case section 334*c*. Also, the piston section 334*e* is configured to slide along the inner peripheral surface of the outer case section 334*a* resisting the reaction force of the helical compression spring 334*f*, when the oil pressure circulating in an oil passage 336*c* of the lower case section 336 is increased by the hydraulic control solenoid valve 37 described above. In this way, the backward and forward switching clutch section 334 can be engaged and disengaged by increasing or decreasing pressure of the oil circulating in the oil passage 336*c* of the lower case section 336.

Further, three inner shaft members 338 and three outer shaft member 339 are fixed to the inner case section 334*c* of the backward and forward switching clutch section 334. Namely, the inner case section 334*c* is connected to the flange portion 337 by the three inner shaft members 338 and the three outer shaft members 339, and configured to rotate together with the flange portion 337 around the axis L1. The outer case section 334*a* of the backward and forward switching clutch section 334 is attached to the lower transmission shaft 335, and configured to rotate together with the lower transmission shaft 335 around the axis L1.

The sun gear 343 is formed integrally in an upper portion of the lower transmission shaft 335. As shown in FIG. 7, the sun gear 343 is engaged with the inner planetary gears 340 as described above, and the inner planetary gears 340 are engaged with the outer planetary gears 341, which are engaged with the ring gear 342. In addition, the sun gear 343 is configured to rotate in the direction "B" around the axis L1 by way of the inner planetary gears 340 and the outer planetary gears 341, when the flange portion 337 is rotated in the direction "A" corresponding to the rotation of the intermediate transmission shaft 331 in the direction "A" around the axis L1, in the case where the backward and forward switching clutch section 333 is engaged and the ring gear 342 does not rotate.

As the planetary gear section 332 and the backward and forward switching clutch sections 333 and 334 are configured as described above, the ring gear 342 mounted to the inner case section 333*b* is fixed relative to the lower case section 336, when the backward and forward switching clutch section 333 is engaged. Since, as described above, the backward and forward switching clutch section 334 is disengaged in this situation, the outer case section 334*a* and the inner case section 334*c* of the backward and forward switching clutch section 334 can be rotated independently. In this case, when the flange portion 337 is rotated in the direction "A" around the axis L1 corresponding to the rotation of the intermediate transmission shaft 331 in the direction "A" around the axis L1, the three inner shaft members 338 and the three outer shaft members 339 are moved respectively in the direction "A" around the axis L1. In this situation, the outer planetary gears 341 attached to the outer shaft members 339 are rotated in the direction "B1" around the outer shaft members 339. Also, corresponding to the rotation of the outer planetary gears 341, the inner planetary gears 340 are rotated in the direction "A3" around the inner shaft members 338. Thus, the sun gear 343 is rotated in the direction "B" around the axis L1. Consequently, as shown in FIG. 5, the lower transmission shaft 335 is rotated in the direction "B" together with the outer case section 334*a* around the axis L1, regardless of the inner case section 334*c* being rotated in the direction "A" around the axis L1. In this way, the lower transmission shaft 335 can be rotated in the opposite direction (direction "B") to the rotational direction of the intermediate shaft 315 (and the upper transmission shaft 311) (direction "A"), when the backward and forward switching clutch section 333 is engaged and the backward and forward switching clutch section 334 is disengaged.

Also, as the planetary gear section 332 and the backward and forward switching clutch sections 333 and 334 are configured as described above, the ring gear 342 attached to the inner case section 333*b* can rotate freely relative to the lower case section 336, when the backward and forward switching clutch sections 333 is disengaged. Note that the backward and forward switching clutch section 334 is configured to be capable of being either engaged or disengaged in this situation as described above.

Next, the case where the backward and forward switching clutch section 334 is engaged will be described. As shown in FIG. 7, when the flange portion 337 is rotated in the direction "A" corresponding to the rotation of the intermediate transmission shaft 331 in the direction "A" around the axis L1, the three inner shaft members 338 and the three outer shaft members 339 are rotated, respectively in the direction "A" around the axis L1. In this situation, the inner planetary gears 340 and the outer planetary gears 341 are idled, since the ring gear 342 engaged with the outer planetary gears 341 is rotated freely. Namely, the driving force of the intermediate transmission shaft 331 is not conveyed to the sun gear 343. On the other hand, since the backward and forward switching clutch section 334 is engaged, the outer case section 334*a* is rotated in the direction "A" around the axis L1 corresponding to the rotation of the inner case section 334*c* in the direction "A" around the axis L1, the inner case section 334*c* being capable of rotating in the direction "A" around the axis L1 together with the three inner shaft members 338 and the three outer shaft members 339, as shown in FIG. 5. Thus, the lower transmission shaft 335, together with the outer case section 334*a*, is rotated in the direction "A" around the axis L1. Consequently, the lower transmission shaft 335 can be rotated in same direction as the rotational direction of the intermediate shaft 315 (and the upper transmission shaft 311) (direction "A"), when the backward and forward switching clutch section 333 is disengaged and the backward and forward switching clutch section 334 is engaged.

As shown in FIG. 4, a speed reduction device 344 is provided below the transmission mechanism 33. The input to the speed reduction device 344 comes from the lower transmission shaft 335 of the transmission mechanism 33. The speed reduction device 344 has a speed-reducing function for the driving force input from the lower transmission shaft 335. Further, a drive shaft 345 is provided below the speed reduction device 344. The drive shaft 345 is configured to rotate in the same direction as the lower transmission shaft 335, and a bevel gear 345*a* is provided in a lower portion of the drive shaft 345.

Also, the bevel gear 345*a* of the drive shaft 345 is engaged with a bevel gear 346*a* of an internal output shaft section 346 and with a bevel gear 347*a* of an external output shaft section 347. The internal output shaft section 346 is disposed to extend rearward (in the direction of an arrow "BWD"), and the propeller 32*b* is installed on a side of the internal out put shaft section 346 in a direction pointed by an arrow "BWD". Similar to the internal output shaft section 346, the external output shaft section 347 is also disposed to extend in the direction of the arrow "BWD", and the propeller 32*a* is installed on the side of the external out put shaft section 347 in the direction pointed by an arrow "BWD". Also, the external output shaft section 347 is preferably hollow, and the internal output shaft section 346 is inserted into the hollow portion. The internal output shaft section 346 and the external output shaft section 347 are configured to allow for rotation independent of each other.

The bevel gear 346*a* is engaged with the bevel gear 345*a* in a side pointed by the arrow FWD, and the bevel gear 347*a* is engaged with the bevel gear 345*a* in a side pointed by the arrow BWD. Thus, as the bevel gear 345*a* rotates, the internal output shaft section 346 and the external output shaft section 347 are rotated in opposite directions from each other.

Specifically, when the drive shaft 345 rotates in the direction "A", the bevel gear 346*a* is configured to rotate in the direction "A4". Further, corresponding to the rotation of the bevel gear 346*a* in the direction "A4", the propeller 32*b* is rotated in the direction "A4" by way of the internal output shaft section 346. Also, when the drive shaft 345 rotates in the direction "A", the bevel gear 347*a* is configured to rotate in the direction "B2", and corresponding to the rotation of the bevel gear 347*a* in the direction "B2", the propeller 32*a* is rotated in the direction "B2" by way of the external output shaft section 347. Then, the watercraft 1 travels in the direction of arrow "FWD" (the direction of forward travel) by the propeller 32*a* being rotated in the direction "B2" and the propeller 32*b* being rotated in the direction "A4" (opposite to the direction "B2").

Also, when the drive shaft 345 rotates in the direction "B", the bevel gear 346*a* is configured to rotate in the direction "B2", and corresponding to the rotation of the bevel gear 346*a* in the direction "B2", the propeller 32*b* is rotated in the direction "B2" by way of the internal output shaft section 346. Further, when the drive shaft 345 rotates in the direction "B", the bevel gear 347*a* is configured to rotate in the direction "A4". In this situation, the external output shaft section 347 is configured not to rotate in the direction "A4", and thus the propeller 32*a* is not rotated in either direction "A4" or "B2". Namely, the propeller 32*b* alone is rotated in the direction "A4". Consequently, the watercraft 1 travels in the direction of arrow "BWD" (the direction of reverse travel) by the propeller 32*b* being rotated in the direction "B2".

Figure 8:
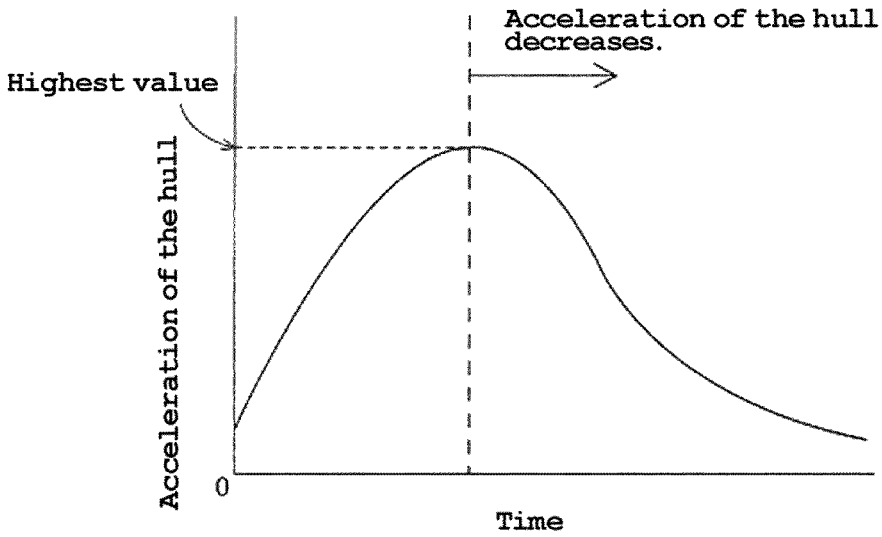
FIG. 8 is a chart showing the change in the acceleration of the hull relative to the elapsed time under the normal acceleration.
Figure 9:
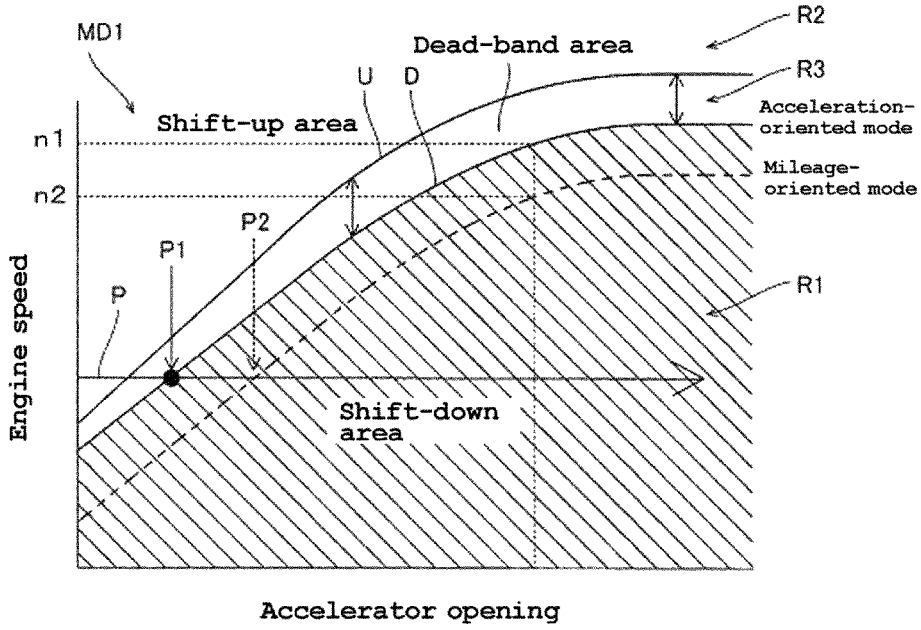
FIG. 9 is a mapping chart illustrating the gear shift-down control map corresponding to an acceleration-oriented mode for the marine propulsion system according to a preferred embodiment of the present invention.
Figure 10:
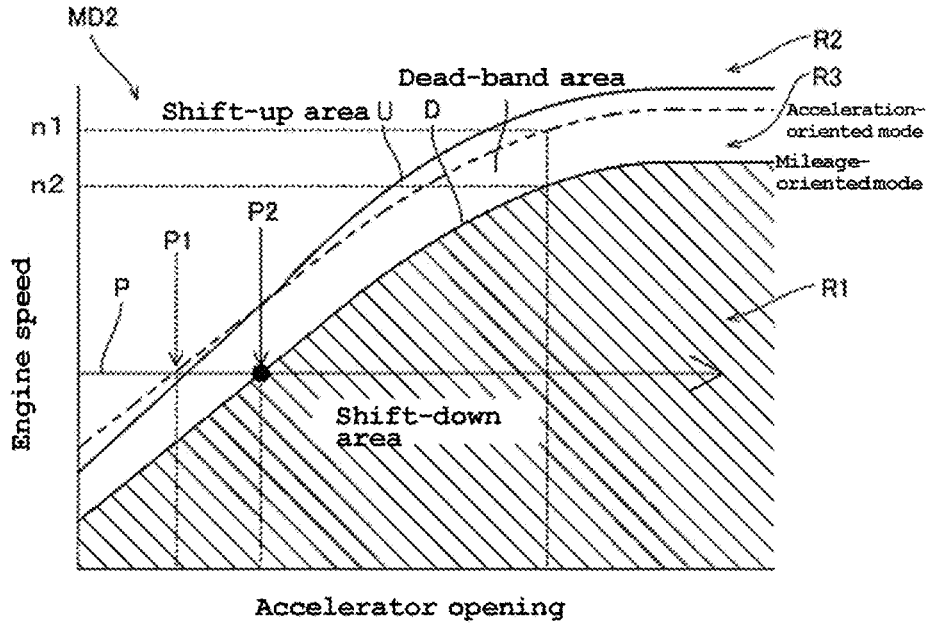
FIG. 10 is a mapping chart illustrating the gear shift-down control map corresponding to a mileage-oriented mode for the marine propulsion system according to a preferred embodiment of the present invention.
Figure 11:
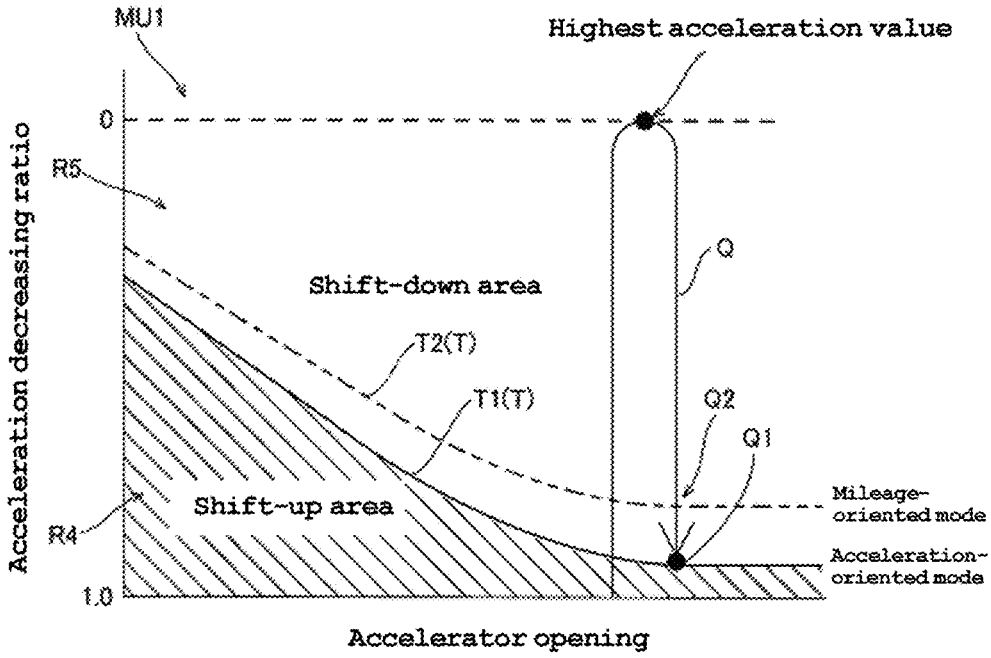
FIG. 11 is a mapping chart illustrating the gear shift-up control map corresponding to the acceleration-oriented mode for the marine propulsion system according to a preferred embodiment of the present invention.
Figure 12:
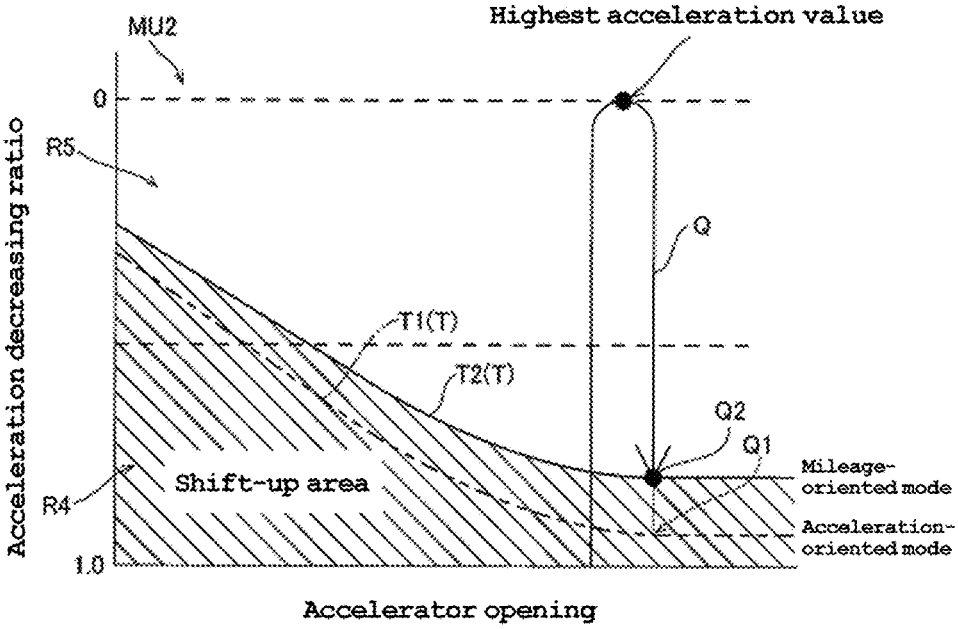
FIG. 12 is a mapping chart illustrating the gear shift-up control map corresponding to the mileage-oriented mode for the marine propulsion system according to a preferred embodiment of the present invention.

FIG. 8 shows the change in the acceleration of the hull relative to the elapsed time under the normal control lever operation. FIGS. 9 and 10 are mapping charts showing a gear shift-down control map that is stored in the memory section of the marine propulsion system according to a preferred embodiment of this invention. FIGS. 11 and 12 are mapping charts showing a gear shift-up control map that is stored in the memory section of the marine propulsion system according to a preferred embodiment of this invention. Next, the gear shift-down control map and the gear shift-up control map will be described in detail, referring to FIGS. 8 through 12.

As shown in FIG. 8, the acceleration of the hull 2 increases gradually with the elapsed time. Then, after the highest acceleration value is reached, the acceleration of the hull 2 decreases gradually. Therefore, it is preferable to control the transmission mechanism 33 in the following manner in order to improve both an acceleration performance and a mileage performance. Namely, when acceleration is required, the acceleration is carried out by shifting into the low speed reduction gear ratio that generates larger torque. Then, after the highest acceleration value is reached, the gear is shifted into the high speed reduction gear ratio while the acceleration of the hull 2 is decreasing after sufficient acceleration. In this preferred embodiment, the gear shift-down control map and the gear shift-up control map are used for carrying out the controls described above. Note that the gear shift-down control map and the gear shift-up control map are an example of "second gear shift control map" and "first gear shift control map" according to a preferred embodiment of the present invention, respectively.

As shown in FIGS. 9 and 10, the gear shift-down control map according to this preferred embodiment is represented by the relationship between the rotation frequency of the engine 31 (engine speed) and the accelerator opening. In the gear shift-down control map, the engine speed is indicated by the vertical axis, while the accelerator opening is indicated by the horizontal axis. In addition, the gear shift-down control map contains a shift-down area R1 defining the low speed reduction gear ratio, a shift-up area R2 defining the high speed reduction gear ratio, and a dead-band area R3 provided between the shift-down area R1 and the shift-up area R2. Note that the shift-down area R1 and the shift-up area R2 are an example of "second area" and "third area" according to a preferred embodiment of the present invention, respectively. Also, the gear shift-down control map according to this preferred embodiment is preferably applied to both the forward operation and the reverse operation.

In this preferred embodiment, the control section 52 and the ECU 34 are configured to control the transmission mechanism 33 to shift down (to shift from the high speed reduction gear ratio into the low speed reduction gear ratio), when a locus P plotted by the engine speed and the accelerator opening of the watercraft 1 moves from the shift-up area R2 into the shift-down area R1 through the dead-band area R3 on the gear shift-down control map. The dead-band area R3 is provided to prevent a frequent shift change, and is configured not to change gears when the track P merely enters from the shift-up area R2 into the dead-band area R3. The dead-band area R3 is provided in a band between a shift-down base line D established in a side of the shift-down area R1 defining the low speed reduction gear ratio, and a shift-up base line U established in a side of the shift-up area R2 defining the high speed reduction gear ratio.

Also in this preferred embodiment, the memory section 51 (see FIG. 2) stores a gear shift-down control map MD1 corresponding to an acceleration-oriented mode shown in FIG. 9, and a gear shift-down control map MD2 corresponding to a mileage-oriented mode shown in FIG. 10. As shown in FIGS. 9 and 10, the shift-down area R1 on the gear shift-down control map MD1 for the acceleration-oriented mode is established in a manner that, when compared at the equivalent accelerator opening, the engine speed n1 at which the shift-down takes place is higher than the engine speed n2 at which the shift-down takes place in the shift-down area R1 on the gear shift-down control map MD2 for the mileage-oriented mode. Thus, in the acceleration-oriented mode, the shift is kept in the low speed reduction gear ratio with larger torque for a longer time in comparison with the case of the mileage-oriented mode. For instance, when the engine speed and the accelerator opening change along the track "P", the shift-down takes place at the timing "P1" in the case of acceleration-oriented mode as shown in FIG. 9. On the other hand, in the case of mileage-oriented mode, the shift-down takes place at the timing "P2" as shown in FIG. 10 at which the accelerator opening is larger (the lever section 5*a* is open more widely) than the timing "P1".

As shown in FIGS. 11 and 12, the gear shift-up control map according to this preferred embodiment is represented by the relationship between the acceleration decreasing ratio and the accelerator opening (the opening of the lever section 5*a*). Here, the acceleration decreasing ratio means the current rate of decrease relative to the highest value of the acceleration, under the condition that the acceleration is decreasing after it has reached the highest value (see FIG. 8). In the gear shift-up control map, the acceleration decreasing ratio is indicated by the vertical axis, while the accelerator opening is indicated by the horizontal axis. Also, the gear shift-up control map contains a shift-up area R4 defining the high speed reduction gear ratio, and a shift-down area R5 defining the low speed reduction gear ratio. In addition, the boundary line T of the shift-up area R4 and the shift-down area R5 is a line that gives a larger acceleration decreasing ratio as the accelerator opening becomes larger. Note that the shift-up area R4 is an example of "first area" according to a preferred embodiment of the present invention. Also, the gear shift-up control map according to this preferred embodiment is preferably applied to both the forward operation and the reverse operation.

In this preferred embodiment, the control section 52 and the ECU 34 are configured to control the transmission mechanism 33 to shift-up (to shift from the low speed reduction gear ratio into the high speed reduction gear ratio), when a locus Q plotted by the acceleration decreasing ratio and the accelerator opening moves from the shift-down area R5 into the shift-up area R4 on the gear shift-up control map.

Also, the memory section 51 stores a gear shift-up control map MU1 corresponding to an acceleration-oriented mode shown in FIG. 11, and a gear shift-up control map MU2 corresponding to a mileage-oriented mode shown in FIG. 12. As shown in FIGS. 11 and 12, the shift-up area R4 defined by a boundary line T1 on the gear shift-up control map MU1 for the acceleration-oriented mode is established in a manner that, when compared at the equivalent accelerator opening, the shift up takes place at a larger acceleration decreasing ratio than in the case of shift-up area R4 defined by a boundary line T2 on the gear shift-up control map MU2 for the mileage-oriented mode. Thus, in the acceleration-oriented mode, the timing of shift-up from the low speed reduction gear ratio with larger torque into the high speed reduction gear ratio is retarded in comparison with the case of the mileage-oriented mode. For instance, when the acceleration decreasing ratio and the accelerator opening change as represented by the locus Q, the shift-up takes place at the timing Q2 in the case of mileage-oriented mode as shown in FIG. 12. On the other hand, the shift-up takes place at the timing Q1 which is later than the timing Q2 in the case of acceleration-oriented mode as shown in FIG. 11. In this way, operation in the low speed reduction gear ratio with larger torque is maintained longer in the acceleration-oriented mode, and thus the acceleration is enhanced.

Figure 13:
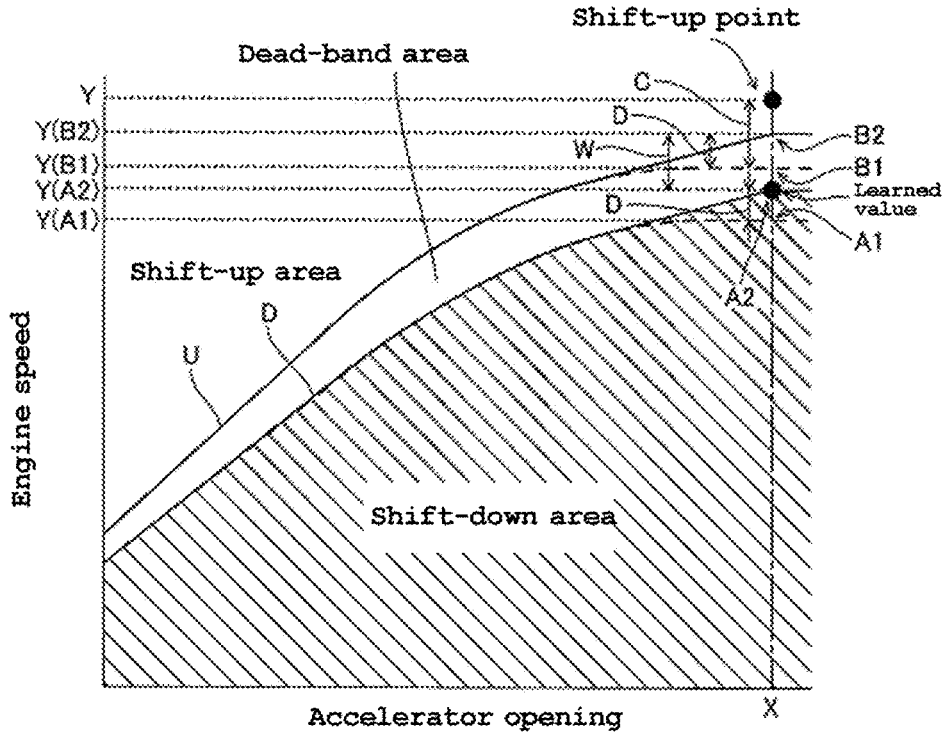
FIG. 13 is a mapping chart illustrating the correction process of the gear shift-up control map for the marine propulsion system according to a preferred embodiment of the present invention.

The control section 52 is configured to correct the gear shift-down control map applying the gear shift timing determined by the gear shift-up control map. FIG. 13 is a mapping chart illustrating a correction process of the gear shift-down control map. The correction process of the gear shift-down control map will be described specifically in the following sections, referring to FIG. 13. Note that the following description is applicable to the correction of the gear shift-down control map MD1 in the acceleration-oriented mode shown in FIG. 9. Also, in FIG. 13, "X" and "Y" represent the accelerator opening and the engine speed, respectively, at which the gear is changed to the high speed reduction gear ratio based on the gear shift-up control map. "A1" represents a boundary point between the shift-down area R1 and the dead-band area R3 corresponding to the accelerator opening (X) on the gear shift-up control map before the correction, and "B1" represents a boundary point between the shift-up area R2 and the dead-band area R3 before the correction. Similarly, "A2" represents a boundary point between the shift-down area R1 and the dead-band area R3 corresponding to the accelerator opening (X) on the gear shift-up control map after the correction, and "B2" represents a boundary point between the shift-up area R2 and the dead-band area R3 after the correction.

In this preferred embodiment, when there is a difference between the engine speed "Y" at which the shift-up is carried out based on the gear shift-up control map (a shift-up point shown in FIG. 13) and the boundary point "B1" between the shift-down area "R1" and the dead-band area "R3" on the gear shift-down control map, the engine speed "Y (B1)" of the boundary point "B1" is corrected to become closer to the engine speed "Y" of the shift-up point. Here, the engine speed "Y" at which the shift-up is carried out at a given accelerator opening varies due to the external factors such as waves and wind. Therefore, the correction is configured not to correct the engine speed "Y(B1)" at the boundary "B1" by the full correction amount "C" to reach the engine speed "Y" of the shift-up point, but to correct it by the correction amount "D" that is smaller than the correction amount "C". In this preferred embodiment, the correction amount D is determined to be D=C/2. Also, the boundary point "A1" is corrected to become closer to the shift-up point by the correction amount "D" simultaneously when the boundary point "B1" is moved closer to the shift-up point by the correction amount "D". By moving the boundary points "A1" and "B1" closer to the shift-up point by the correction amount "D" in this way, the boundary point between the shift-up area R2 and the dead-band area R3 moves to "B2" and the boundary point between the shift-down area R1 and the dead-band area R3 moves to "A2" on the corrected gear shift-down control map. Note that the width of the dead-band area R3 before the correction (Y(B1)-Y(A1)) is equal to the width of the dead-band area R3 after the correction (Y(B2)-Y(A2)). By the aforementioned correction process that is performed every time the shift-up is carried out, the gear shift-down control map can be corrected to shift down at the optimal timing in the actual operating conditions.

Figure 14:
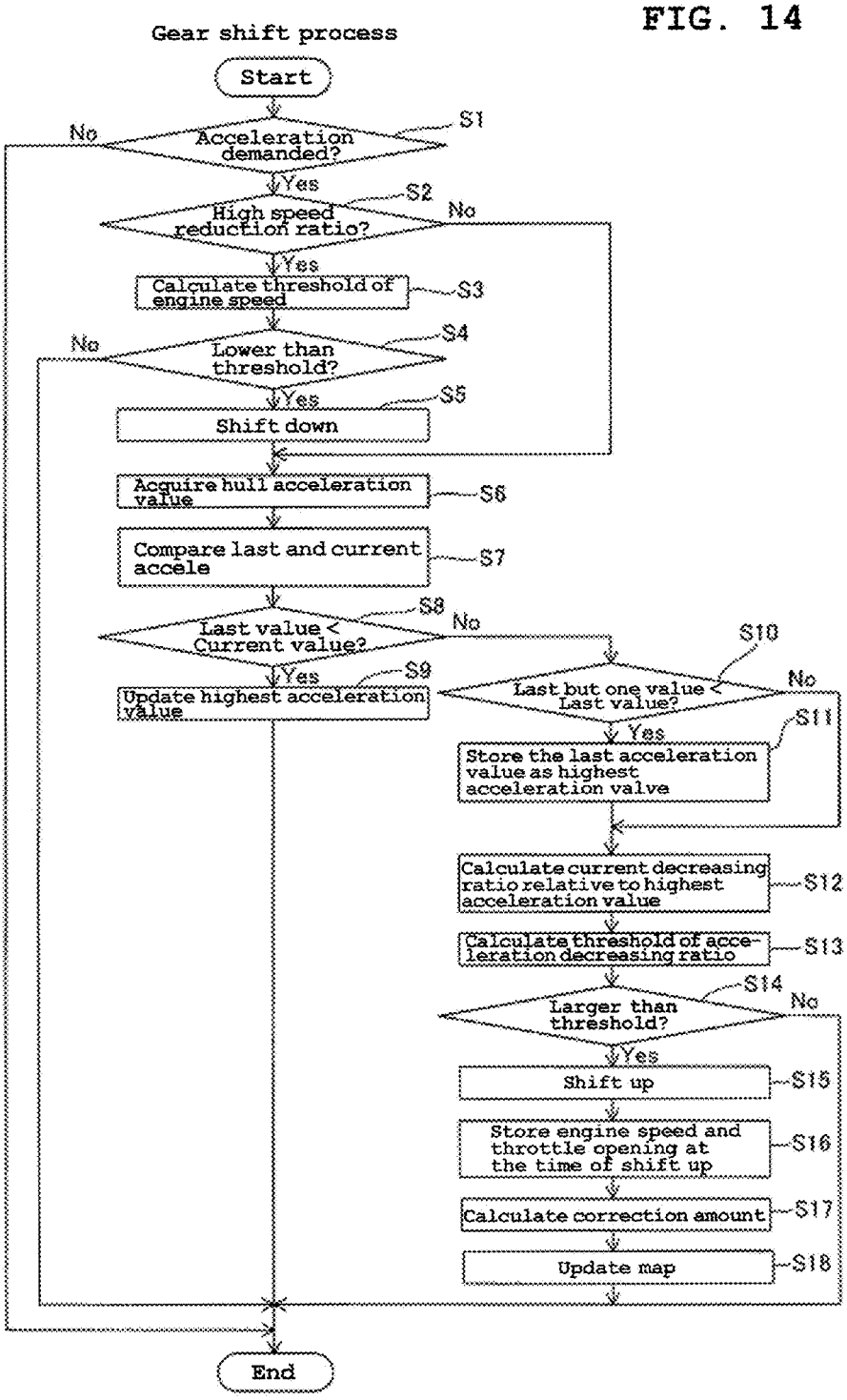
FIG. 14 is a flow chart illustrating the gear shift process of the marine propulsion system according to a preferred embodiment of the present invention.

FIG. 14 is a flow chart illustrating the gear shift process of the marine propulsion system according to a preferred embodiment of this invention. Next, the gear shift process of the marine propulsion system according to this preferred embodiment will be described, referring to FIGS. 9 through 14. The gear shift process is for carrying out the control by which the speed reduction gear is maintained at the high speed reduction gear ratio in the normal running conditions, while it is changed into the low speed reduction gear ratio only when the acceleration is demanded in order to improve both the acceleration performance and the mileage performance of the hull. A series of process shown in the flow chart is carried out generally at every 100 msec., for example, at all times.

When a boat driver rotates the lever section 5*a* for propelling the hull 2, the control section 52 determines if acceleration is demanded or not in Step S1 of FIG. 14. Specifically, the control section 52 calculates the amount of change per unit time regarding the lever opening of the lever section 5*a* (rotating speed of the lever). Then, when the rotating speed of the lever is lower than a predetermined value (when the lever section 5*a* is rotated slowly), the control section 52 determines that the boat driver is not demanding acceleration, and the gear shift process is terminated. If the rotating speed of the lever is higher than the predetermined value (when the lever section 5*a* is rotated quickly), the control section 52 determines that the boat driver is demanding acceleration. When the determination is made that the boat driver is demanding acceleration, and the rotating speed of the lever is relatively high, the control section 52 determines that the boat driver has an intention of hard acceleration, in other words, the driver puts an emphasis on the acceleration, and determines to take the acceleration-oriented mode. When the rotating speed of the lever is higher than the predetermined value, but is relatively low, the control section 52 determines that the boat driver has an intention of slow acceleration, in other words, the driver puts an emphasis on fuel economy, and determines to take the mileage-oriented mode.

After the determination is made to take the acceleration-oriented mode or the mileage-oriented mode, the control section 52 determines whether the gear is in the high speed range reduction ratio or in the low speed range reduction ratio in Step S2. When the gear is in the low speed range reduction ratio, the process goes to Step S6. When the gear is in the high speed range reduction ratio, a threshold for the shift-down operation is calculated using the gear shift-down control map (see FIGS. 9 and 10). Specifically, the threshold to carry out the shift-down operation is calculated based on the boundary line D between the shift-down area R1 and the dead-band area R3 on the gear shift-down control map, and the current accelerator opening. In this process, the gear shift-down control map MD1 shown in FIG. 9 is applied when the determination was made in Step S1 to take the acceleration-oriented mode, while the gear shift-down control map MD2 shown in FIG. 10 is applied when the determination was made in Step S1 to take the mileage-oriented mode.

Next, in Step S4, determination is made whether the current engine speed is lower than the threshold calculated in Step S3 or not. When the current engine speed is higher than the threshold, the control section 52 determines that the shift down is not required, and the gear shift process is terminated maintaining the high speed reduction gear ratio. When the current engine speed is lower than the threshold, the shift-down (to shift from the high speed reduction gear ratio into the low speed reduction gear ratio) is carried out in Step S5.

Then, after shifting into the low speed reduction gear ratio, the control section 52 acquires a hull acceleration value detected by the acceleration sensor 55. Also, comparison is made between the acceleration value at the last gear shift process (generally, about 100 msec. ago, for example) and the current acceleration value in Step S7. When the last acceleration value is determined to be smaller than the current acceleration value in Step S8, the current acceleration value is stored as the highest acceleration value in the memory section 51 in Step S9, since the acceleration is increasing. In this case, the acceleration has not reached the highest value yet, and sufficient acceleration has not been achieved. Thus, the gear shift process is terminated maintaining the low speed reduction gear ratio.

When the last acceleration value is determined to be larger than the current acceleration value in Step S8, determination is made whether the last but one acceleration value is larger than the last acceleration value in Step 10. When the last but one acceleration value is larger than the previous acceleration value, it means that the acceleration is decreasing from the last but one value to the current value. Thus, the process goes to Step S12 without updating the highest acceleration value. When the next to last acceleration value is smaller than the previous acceleration value, it means that the previous acceleration value is the highest value of the acceleration. Thus, the previous acceleration is stored in the memory section 51 as the highest acceleration value in Step 11.

Next, in Step S12, the current acceleration decreasing ratio relative to the highest acceleration value stored in the memory section 51 is calculated. Also, in Step S13, the threshold for the shift-up operation is calculated applying the gear shift-up control map (see FIGS. 11 and 12). Specifically, the threshold of the acceleration decreasing ratio to carry out the shift-down operation is calculated based on the boundary line T defining the shift-up area R4 on the gear shift-up control map, and the current accelerator opening. In this process, the gear shift-up control map MU1 shown in FIG. 11 is applied when the determination was made in Step S1 to take the acceleration-oriented mode, while the gear shift-up control map MU2 shown in FIG. 12 is applied when the determination was made in Step S1 to take the mileage-oriented mode.

Next, in Step S14, determination is made whether the current acceleration decreasing ratio is smaller than the threshold calculated in Step S12 or not. When the current acceleration decreasing ratio is smaller than the threshold, it is determined that sufficient acceleration has not been achieved. Thus, the gear shift process is terminated maintaining the low speed reduction gear ratio. When the current acceleration decreasing ratio is larger than the threshold, it is determined that the sufficient acceleration has been achieved already. Thus, the shift-up (to shift from the low speed reduction gear ratio into the high speed reduction gear ratio) is carried out in Step S15.

Further in Step S16, the engine speed and the accelerator opening at the time of shift up carried out in Step S15 are stored in the memory section 51. Then, in Step S17, the control section 52 calculates the correction amount D. Specifically, a half amount of the difference "C" between the engine speed "Y(B1)" at the boundary point "B1" and the engine speed "Y" at which the shift-up is carried out in FIG. 13, is calculated as the correction amount "D". Then in Step S18, the gear shift-down control map is updated based on the correction amount "D". Specifically, by adding the correction amount "D" to the engine speed "Y(A1)" at the boundary point "A1" and to the engine speed "Y" at the boundary point "B1" respectively, correction is made to set the boundary point between the shift-down area R1 and the dead-band area R3 at "A2" and the boundary point between the shift-up area R2 and the dead-band area R3 at "B2", for the accelerator opening "X" as shown in FIG. 13. The corrected gear shift-down control map is applied to the shift-down operation in the subsequent gear shift process. The gear shift process of the marine propulsion system according to this preferred embodiment is carried out in this way.

In this preferred embodiment, the acceleration sensor 55 for detecting the acceleration of the hull 2 is provided as described above. Thus, when the marine propulsion system according to a preferred embodiment of the present invention is applied to the various hull models having different sizes and shapes, the control section 52 can distinguish the actual accelerating state for each type of hull. Thus, different from the case where the accelerating state of the hull is estimated based on the engine speed and the throttle opening, the control section 52 can distinguish the actual accelerating state that varies between each hull model. Also, by controlling the transmission mechanism 33 to shift from the low speed reduction gear ratio into the high speed reduction gear ratio based on the acceleration of the hull 2, shifting from the low speed reduction gear ratio into the high speed reduction gear ratio can be carried out in response to the actual accelerating state of the hull. Thus, shifting from the low speed reduction gear ratio into the high speed reduction gear ratio can be carried out at the optimal timing depending on each hull model.

Further, in this preferred embodiment, shifting from the low speed reduction gear ratio into the high speed reduction gear ratio takes place when the acceleration decreasing ratio relative to the highest acceleration value of the hull 2 exceeds the predetermined threshold after the acceleration of the hull 2 began to decrease from the highest value, as described above. Therefore, shifting from the low speed reduction gear ratio into the high speed reduction gear ratio takes place after the hull 2 achieved sufficient acceleration.

Further, in this preferred embodiment, the boundary line "T" defining the shift-up area R4 on the gear shift-up control map is set as a line that gives larger acceleration decrease of the hull 2 as the accelerator opening becomes larger, as described above. Thus, the shift-up can be carried out at such timing that reflects an intention of the boat driver. Namely, when the accelerator opening is small, the boat driver is not demanding a substantial acceleration. In this case, the shift-up is carried out immediately after reaching the highest acceleration value at which the acceleration decreasing ratio is small. When the accelerator opening is large, the boat driver is demanding a substantial acceleration. In this case, the low speed reduction gear ratio is maintained until the acceleration decreasing ratio gets higher, so that the shift-up is carried out after sufficient acceleration is achieved.

Further, in this preferred embodiment, the gear shift is carried out by applying the gear shift control maps (the gear shift-up control map and the gear shift-down control map) corresponding to an acceleration-oriented mode, and the gear shift control maps corresponding to a mileage-oriented mode, as described above. Thus, when the boat driver puts an emphasis on acceleration, the timing for shifting from the low speed reduction gear ratio to the high speed range reduction gear can be relatively retarded by applying the gear shift control maps for the acceleration-oriented mode on which narrower shift-up areas R2 and R4 are used. This allows longer operation in the low speed reduction gear ratio, and acceleration can be enhanced. When the boat driver puts an emphasis on mileage, the timing for shifting from the low speed reduction gear ratio to the high speed range reduction gear can be relatively advanced by applying the gear shift control maps for the mileage-oriented mode on which wider shift-up areas R2 and R4 are used. This allows longer operation in the higher speed range reduction gear ratio, and mileage can be improved.

Further, in this preferred embodiment, the gear is shifted into the low speed reduction gear ratio when a locus P plotted by the engine speed and the accelerator opening moves from the shift-up area R2 into the shift-down area R1 through the dead-band area R3 on the gear shift-down control map, as described above. Thus, the shift-down operation can be carried out at the optimal timing by appropriately setting the boundary lines D and U.

Further, in this preferred embodiment, the gear shift-down control maps are corrected using the throttle opening and the engine speed at the time of shifting from the low speed reduction gear ratio into the high speed reduction gear ratio, as described above. Thus, the gear shift-down control map can be updated to allow the shift-down operation at the optimal timing. Namely, since the timing of the shift-up operation determined by the acceleration of the hull 2 is considered to be the optimal timing reflecting the actual acceleration state of the hull 2. Therefore, by correcting the timing of the shift-down operation according to relevant shift-up timing (in terms of throttle opening and engine speed), the gear shift-down control maps can be updated to allow the optimal timing for the shift-down operation as well. In this way, the optimal timing for the shift-down operation that matches every hull 2 can be learned, when the outboard motor 3 is installed on the different models of hull 2.

Note that the present preferred embodiment described above is merely an example in every aspect, and it should not be considered to limit the present invention in any way. The scope of the present invention is not defined by the aforementioned description of the preferred embodiment, but by the claims. Also the scope of this invention includes every modification within the equivalent meaning and scope of the claims.

For instance, in the above-described preferred embodiment, the marine propulsion system preferably provided with two outboard motors of which the engines and propellers are disposed outside of the hull is described as an example. However, this invention is not limited to the above-mentioned example, but is also applicable to other types of marine propulsion system provided with a stern drive in which the engine is fixed to the hull, an inboard engine in which the engine and the propeller are fixed to the hull, and so on. Also, the present invention is applicable to the marine propulsion system provided with a single outboard motor as well.

Further, in the above-described preferred embodiment, the acceleration sensor 55 that acquires the acceleration directly is described as an example of an acceleration detecting section. However, this invention is not limited to the above-mentioned example. GPS (global positioning system) may be utilized to calculate the acceleration of the hull 2.

Further, in the above-described preferred embodiment, the gear shift-down control map and the gear shift-up control map on which the accelerator opening is indicated by the horizontal axis is described as an example. However, this invention is not limited to the above-mentioned example. The intake pressure of the engine or the engine speed may be indicated by the horizontal axis. Also, the throttle opening (opening of the throttle valve provided in the intake passage of the engine) may be indicated by the horizontal axis of the gear shift-sown control map and the gear shift-up control map.

Further, in the above-described preferred embodiment, an example is described in which the shift-up operation is carried out when the acceleration decreasing ratio relative to the highest acceleration value of the hull reaches the predetermined value. However, this invention is not limited to the above-mentioned example, but can be configured so that the shift up operation is carried out after a predetermined period of time has passed after reaching the highest acceleration value of the hull. In this case, a gear shift-up control map on which the horizontal axis and the vertical axis indicate the accelerator opening and the elapsed time from the point of highest acceleration value of the hull, respectively, may be used. The gear shift-up control map can be established by utilizing the gear shift-up control map shown in FIG. 11 with the vertical axis modified to indicate the elapsed time instead of the acceleration decreasing ratio of the hull.

Further, in the above-described preferred embodiment, the marine propulsion system provided with an outboard motor with two propellers is described as an example. However, this invention is not limited to the above-mentioned example, but is applicable to other types of marine propulsion system including an outboard motor with a single propeller or three or more propellers.

Further, in the above-described preferred embodiment, the marine propulsion system preferably provided with two outboard motors is described as an example. However, this invention is not limited to the above-mentioned example, but may be provided with a single outboard motor, or three or more outboard motors. When plural outboard motors are provided, they may be configured to synchronize the gear shift timings of all the outboard motors. In this case, the outboard motors may be configured in a manner that one of the outboard motors may be designated as a main motor, and when the gear shift control is carried out in the transmission mechanism on the main motor, the gear shift control is carried out simultaneously for the rest of the outboard motors. Specifically, the gear shift control may be carried out in the following procedure. Namely, the control section 52 sends out a "transmission gear change signal" to the ECU on the main motor based on the gear shift control maps stored in the memory section 51 of the control lever unit 5. Based on the "transmission gear change signal", the ECU on the main motor sends out a "driving signal" or a "non-driving state maintaining signal" to the hydraulic control solenoid valve 37 on the main motor. Consequently, the upper transmission section 310 is shifted into the low speed reduction gear ratio. The ECU on the main motor also sends out the "driving signal" or the "non-driving state maintaining signal" to the ECUs installed on the rest of the outboard motors by way of the common LAN cable. Based on the signals sent out by the ECU on the main motor, the ECUs on the rest of the outboard motors send out the "driving signal" or the "non-driving state maintaining signal" to the hydraulic control solenoid valve 37 on their own motors. Consequently, the upper transmission section 310 on the main motor, and the upper transmission section 310 on the rest of the outboard motors are shifted into the low speed reduction gear ratio in a synchronized manner.

Also, ECU on each of the plural outboard motors may be configured to send out the transmission gear change signal not only to their own transmission mechanism, but also to the transmission mechanisms on other outboard motors, and at the same time, they may be configured to carry out shifting in the transmission mechanism based on the transmission gear change signal that was received first among the transmission gear change signals sent out by the plural ECUs. Specifically, the gear shift control may be carried out in the following procedure. Namely, the control section 52 sends out the "transmission gear change signal" to each of the ECUs on all the outboard motors, based on the gear shift control maps stored in the memory section 51 of the control lever unit 5. Based on the "transmission gear change signal", the ECU on each outboard motor sends out the "driving signal" or the "non-driving state maintaining signal" to the hydraulic control solenoid valve 37 on its own motor. At the same time, the ECU on each outboard motor sends out the "driving signal" or the "non-driving state maintaining signal" to the hydraulic control solenoid valve 37 on other motors by way of the common LAN cable. The hydraulic control solenoid valve 37 on each outboard motor is switched to the driving state or to the non-driving state based on the "driving signal" or the "non-driving state maintaining signal" that was received first. Consequently, the upper transmission section 310 on each of the plural outboard motors is shifted into the low speed reduction gear ratio in a synchronized manner.

When the shift timings of all the outboard motors are synchronized, the control section 52 of the control lever unit 5 sends out the "transmission gear change signal" when one of the following conditions is met. Namely, the "transmission gear change signal" is sent out when the operating state of any one of the plural outboard motors meets the conditions for carrying out the gear shift, or when the operating state of the particular outboard motor among the plural outboard motors meets the conditions for carrying out the gear shift.

Further, in the above-described preferred embodiment, an example is described in which the gear shift control maps are stored in the memory section 51 contained in the control lever unit 5, and at the same time, the control signal for the transmission mechanism 33 to change the reduction gear ratio is sent out by the control section 52 contained in the control lever unit 5. However, this invention is not limited to the above-mentioned example, and the gear shift control maps can be stored in the ECU 34 provided within the outboard motor. In this case, the control signal may also be configured to be sent out by the ECU 34 in which the gear shift control maps are stored. Further, there is another configuration in which an ECU other than the one for controlling the engine is provided, and the gear shift control maps may be stored and the control signal may be sent out by this additional ECU.

Further, in the above-described preferred embodiment, an example is described in which shifting into forward, neutral and reverse is carried out by the lower transmission section 330 which is controlled electrically by the ECU 34. However, this invention is not limited to the above-mentioned example, and shifting into forward, neutral and reverse may be carried out by a mechanical forward-reverse switching mechanism made up of a pair of bevel gears and a dog clutch, as disclosed in JP-A-Hei 9-263294 discussed above.

Further, in the above-described preferred embodiment, an example is described in which the gear shift control maps for the reverse operation of the hull preferably are configured similarly to the gear shift control maps for the forward operation of the hull. However, this invention is not limited to the above-mentioned example, and two types of gear shift control maps may be provided; one is applicable to the forward operation only, and the other is applicable to the reverse operation only.

Further, in the above-described preferred embodiment, an example is described in which the control section and the ECU are configured to be able to communicate with each other preferably by way of the common LAN cables. However, this invention is not limited to the above-mentioned example, and the control section and the ECU may be configured to be able to communicate with each other by means of wireless communication.

Further, in the above-described preferred embodiment, an example is described in which the shift position signal is transmitted from the control section to the ECU preferably only by way of the common LAN cable 7, while the accelerator opening signal is transmitted from the control section to the ECU preferably only by way of the common LAN cable 8. However, this invention is not limited to the above-mentioned example, and both the sift position signal and the accelerator opening signal may be transmitted from the control section to the ECU by way of a single common LAN cable. Also, there is another configuration in which the shift position signal may be transmitted from the control section to the ECU only by way of the common LAN cable 8, while the accelerator opening signal may be transmitted from the control section to the ECU only by way of the common LAN cable 7.

Further, in the above-described preferred embodiment, the crankshaft rotation frequency is used as an example of the engine speed. However, this invention is not limited to the above-mentioned example, and the rotation frequency of a member (shaft) other than the crankshaft that rotates according to the rotation of the crankshaft within the engine may be used as the engine speed.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine propulsion system comprising:

an engine;

a propeller arranged to be rotated by a driving force generated by the engine;

a transmission mechanism arranged to convey the driving force of the engine to the propeller at least after shifting into a low speed reduction gear ratio and into a high speed reduction gear ratio;

an acceleration detecting section arranged to detect acceleration of a hull propelled by the rotation of the propeller; and a control section arranged to carry out the control for changing the reduction gear ratio of the transmission mechanism; wherein the control section is arranged to control the transmission mechanism to shift from the low speed reduction gear ratio into the high speed reduction gear ratio based on the acceleration of the hull detected by the acceleration detecting section; and the control section is arranged to control the transmission mechanism to shift into the high speed reduction gear ratio, based on a first gear shift control map representing criteria for shifting the transmission mechanism from the low speed range reduction ratio into the high speed range reduction ratio by using a decreasing ratio of the acceleration of the hull and an accelerator opening.

2. The marine propulsion system according to claim 1, wherein the first gear shift control map includes a first area in which the gear is shifted from the low speed range reduction ratio into the high speed range reduction ratio, and the control section is arranged to control the transmission mechanism to shift into the high speed reduction gear ratio when a locus plotted by the decreasing ratio of acceleration of the hull and the accelerator opening enters the first area on the first gear shift control map, in which the gear is shifted into the high speed range reduction ratio.

3. The marine propulsion system according to claim 2, wherein a boundary line defining the first area on the first gear shift control map is a line that provides a larger acceleration decrease of the hull as the accelerator opening becomes larger.

4. The marine propulsion system according to claim 1, wherein the first gear shift control map includes a first gear shift control map corresponding to an acceleration-oriented mode, and a first gear shift control map corresponding to a mileage-oriented mode, and the control section is arranged to determine the mode either in the acceleration-oriented mode or the mileage-oriented mode, and to control the transmission mechanism based on the first gear shift control map corresponding to the determined mode.

5. The marine propulsion system according to claim 1, further comprising a control lever unit arranged to control a throttle opening through the operation by a boat driver while the hull is propelled, wherein the control section is arranged to carry out the control for changing the reduction gear ratio of the transmission mechanism according to the operation of the control lever unit, and the control section is arranged to control the transmission mechanism to shift into the low speed reduction gear ratio based on a second gear shift control map representing criteria for changing the reduction gear ratio by using the engine speed and the accelerator opening.

6. The marine propulsion system according to claim 5, wherein the second gear shift control map includes a second area defining the low speed reduction gear ratio and a third area defining the high speed reduction gear ratio, and the control section is arranged to control the transmission mechanism to shift into the low speed reduction gear ratio when a locus on the second gear shift control map plotted by the engine speed and the accelerator opening according to the operation of the control lever unit by the boat driver, enters from the third area into the second area on the second gear shift control map.

7. The marine propulsion system according to claim 5, wherein the second gear shift control map includes a second gear shift control map corresponding to the acceleration-oriented mode, and a second gear shift control map corresponding to the mileage-oriented mode, and the control section is arranged to determine the mode either in the acceleration-oriented mode or the mileage-oriented mode, and to control the transmission mechanism based on the second gear shift control map corresponding to the determined mode.

8. The marine propulsion system according to claim 5, wherein the control section is arranged to correct the second gear shift control map using the accelerator opening and the engine speed at the time of shifting from the low speed reduction gear ratio into the high speed reduction gear ratio based on the acceleration of the hull.

9. The marine propulsion system according to claim 5, further comprising a memory section in which the first gear shift control map and the second gear shift control map are stored.

* * * * *